United States Patent [19]

Flumm et al.

[11] 3,930,359

[45] Jan. 6, 1976

[54] DIGITAL COOKING TIMER MEANS HAVING CONCENTRIC TIME INDICATOR DISC AND MANUAL READOUT INDICATOR

[75] Inventors: Paul T. Flumm, Oakville; Vernon B. Harris, Waterbury, both of Conn.

[73] Assignee: Robertshaw Controls Company, Richmond, Va.

[22] Filed: Aug. 20, 1973

[21] Appl. No.: 390,118

[52] U.S. Cl. ..... 58/21.14; 58/125 B; 58/126 E; 58/127 R; 200/38 FA

[51] Int. Cl.[2] ..... G04F 3/04; H01H 43/04

[58] Field of Search .. 200/38 R, 38 A, 38 F, 38 FB, 200/308; 58/4, 5, 16, 19–21.1, 126, 127, 58/21.13, 21.13, 21.14, 125 B, 128, 38.5

[56] References Cited

UNITED STATES PATENTS

| | | | |
|---|---|---|---|
| 2,633,696 | 4/1953 | Youhouse | 58/125 B |
| 3,566,599 | 3/1971 | Bussett | 58/128 X |
| 3,610,753 | 10/1971 | Neubauer | 58/21.13 X |
| 3,857,234 | 12/1974 | Flumm et al. | 58/21.14 |

*Primary Examiner*—James R. Scott

*Attorney, Agent, or Firm*—Candor, Candor & Tassone

[57] ABSTRACT

A digital cooking hours timer for providing an automatic cooking operation of a cooking apparatus for a selected time period and having a frame provided with a timer unit and a drive mechanism for driving the timer unit. A selector is carried by the frame to set a selected period of cooking time of the timer unit and is adapted to interconnect the drive mechanism with the timer unit so as to cause the drive mechanism to drive the timer unit for only the set period of cooking time, the timer unit having an output for operating the cooking apparatus at least part of the set period of cooking time as the set period of cooking time is elapsing.

3 Claims, 19 Drawing Figures

DIGITAL COOKING TIMER MEANS HAVING CONCENTRIC TIME INDICATOR DISC AND MANUAL READOUT INDICATOR

This invention relates to a digital cooking hours timer for a cooking apparatus and, in particular, to a digital cooking hours timer that is adapted to be utilized in combination with a conventional clock structure for providing an automatic cooking operation of the cooking apparatus.

It is well known that timer units have been provided for cooking apparatus whereby each unit includes a conventional clock structure provided with rotatable hands for continuously indicating the time of day. Usually, in combination with such clock structure, windows are provided in the timer unit along with printed timer discs of conventional time indication to be set for a desired cooking time period whereby such timer mechanism will thereafter operate the heating means of the oven to cook an item during the elapsing of such selected time period.

It is a feature of this invention to provide a range timer for the above purpose, but having a digital cooking hours timer in combination with a conventional clock structure so that the resulting unit can be utilized in combination with a cooking apparatus or the like.

Another feature of this invention is to provide a digital cooking hours timer that can be utilized by itself or for other purposes as desired.

Another feature of this invention is to utilize such a range timer together with a digital timer means for providing a minute-by-minute timing operation separate from the time of day clock structure and separate from the digital cooking hours timer as will be apparent hereinafter.

In particular, one embodiment of this invention provides a frame means carrying a timer means and a drive means for driving the timer means. Setting means are carried by the frame means to set a selected period of cooking time of the timer means. Means are also provided for interconnecting the drive means and the timer means together to cause the drive means to drive the timer means for only the set period of cooking time. The timer means has means for operating the cooking apparatus at least part of the set period of cooking time as the set period of cooking time is elapsing whereby the digital cooking hours timer is adapted to provide an automatic cooking operation of the cooking apparatus for the selected time period.

The digital cooking hours timer of this invention has digital reading means for indicating the selected set period of cooking time thereof and for thereafter providing a countdown readout of the set period of cooking time as the same is elapsing.

In this embodiment of the invention, the digital reading means comprises a pair of different sized, concentrically mounted and rotatable discs respectively having time indicating indicia disposed adjacent the outer peripheries thereof with the outer peripheries of such discs respectively having adjacent sections thereof being viewable through an opening in the panel structure to provide the indicated time of the timer means.

Accordingly, it is a feature of this invention to provide a digital cooking hours timer having one or more of the novel features set forth above or hereinafter shown or described.

Another object of this invention is to provide an improved range timer.

Other objects, uses and advantages of this invention are apparent from a reading of this description, which proceeds with reference to the accompanying drawings forming a part thereof and wherein.

Figure 1:
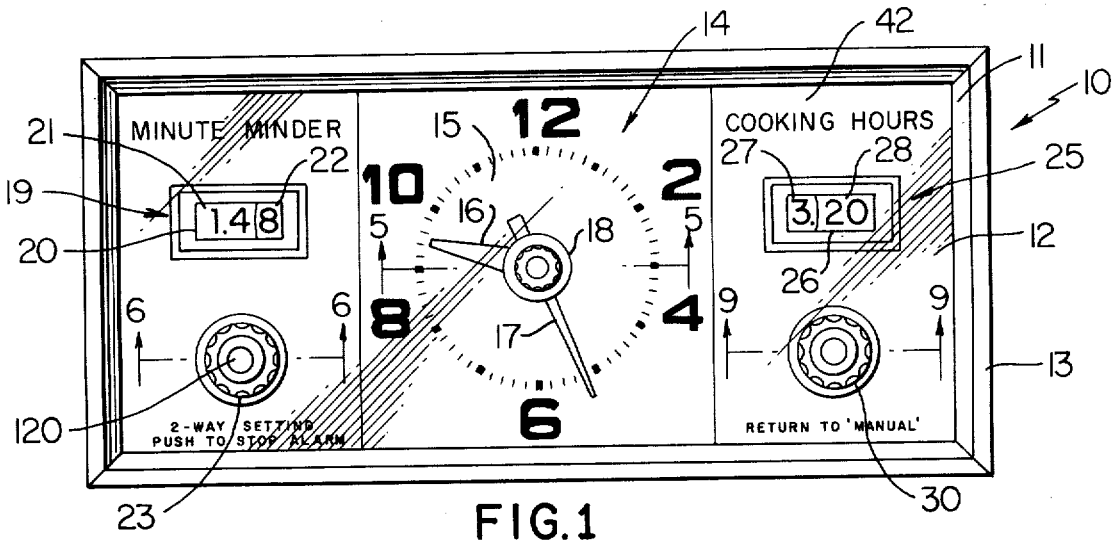
FIG. 1 is a front view of the improved range timer of this invention with the digital minute timer thereof set for a time period of one hour and forty-eight minutes while the digital cooking hours timer thereof has been set for an automatic cooking operation of a cooking apparatus for a period of three hours and twenty minutes.

While the various features of this invention are hereinafter described and illustrated as being particularly adapted to provide a digital cooking hours timer for use with a time-of-day clock structure for providing a range timer for a cooking apparatus, it is to be understood that the various features of this invention can be used singly or in any combination thereof to provide a digital cooking hours timer for use by itself or in combination with other structures as desired.

Therefore, this invention is not to be limited to only the embodiments illustrated in the drawings, because the drawings are merely utilized to illustrate some of the wide variety of uses of this invention.

Referring now to FIG. 1, the improved range timer construction of this invention is generally indicated by the reference numeral 10 and comprises a frame structure generally indicated by the reference numeral 11 and having a front dial plate or panel 12 and a bezel 13, the frame 11 having means for mounting the range timer 10 to a control panel of a conventional cooking apparatus in a manner well known in the art.

The range timer construction 10 includes a time-of-day clock means that is generally indicated by the reference numeral 14 and comprising a clock face 15 disposed on the front panel 12 and having an hour hand 16 and minute hand 17 concentrically mounted to indicate time of day in combination with the dial face 15 in a conventional manner. The clock structure 14 is adapted to have the hands 16 and 17 thereof set by a selector knob 18 in a manner conventional in the art.

The range timer construction 10 includes a digital minute timer of this invention that is generally indicated by the reference numeral 19 and comprises a substantially rectangular window 20 formed through the front panel 12 and exposing sections of a pair of concentrically mounted, different sized discs 21 and 22 operated in a manner hereinafter described to be set to a desired indicating time period by a selector knob 23 rotated in either a clockwise or counterclockwise direction to set the selected time period for the minute timer means 19. The selected time period for the minute timer means 19 illustrated in FIG. 1 is one hour and forty-eight minutes. The selected time period of the minute timer means 19 is directly selected by the selector knob 23, as will be apparent hereinafter, and the discs 21 and 22 are operated by timer means in the manner hereinafter described to provide a minute by minute digital countdown of the elapsing time period and when the discs 21 and 22 subsequently indicate the zero position "00", the timer means is automatically disconnected from the discs 21 and 22 and an alarm is provided by the range timer 10 in the form of a bell 119, FIG. 3, being repetitively hit by an oscillating hammer member 125, FIG. 7A, in a manner hereinafter described until the operator pushes inwardly on the selector knob 23 in a push button manner as will be apparent hereinafter to terminate the sounding of the alarm. At this time, the digital minute timer means 19 remains dormant until again set for a new time period.

Therefore, it can be seen that the range timer means 10 of this invention provides a digital minute timer means 19 completely separate from the conventional clock means 14 so that the housewife or the like will not have to bother with the conventional clock means 14 to set the desired time period for digital minute timer means 19 and the digital minute timer means 19 will directly indicate the selected time by a digital readout arrangement thereof that is completely separate from the conventional clock means 14. Such digital reading means of the minute timer means 19 will thereafter continuously indicate a digital countdown of the elapsing time period so that the housewife or the like will know how much of the selected time period remains during the running thereof.

Figure 2:
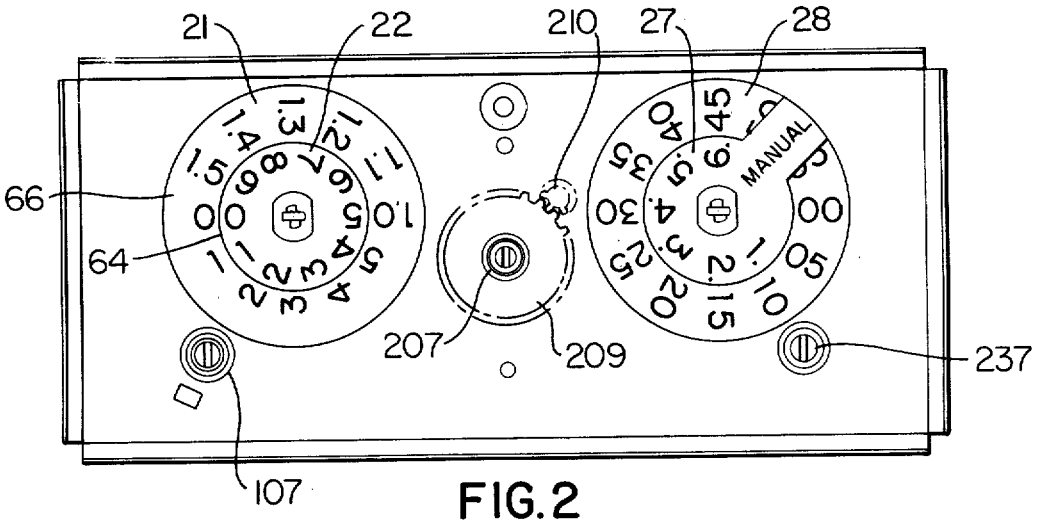
FIG. 2 is a front view of the range timer illustrated in FIG. 1 with the front panel removed to expose the timer discs, the digital minute timer of FIG. 2 and the digital cooking hours timer of FIG. 2 being respectively disposed in their zero time or "off" positions thereof.

The range timer construction 10 also includes a digital cooking hours timer means of this invention that is generally indicated by the reference numeral 25 in FIG. 1 and also comprises a substantially rectangular window 26 formed through the front panel 12 and exposing sections of a pair of concentrically mounted, different sized discs 27 and 28 operated in a manner hereinafter described to be set to te desired indicating time period that food or the like is to be cooked in a cooking apparatus 29, FIG. 3, by a selector knob 30 rotated to set a selected cooking hour time period for the timer means 25. The selected cooking time period for the cooking timer means 25 illustrated in FIG. 1 is three hours and twenty minutes. The selected cooking time period of the cooking hours timer means 25 is directly selected by the knob 30, as will be apparent hereinafter, and the discs 27 and 28 are operated by timer means in a manner hereinafter described to provide a five-minute by five-minute digital countdown of the elapsing cooking time period and when the discs 27 and 28 subsequently indicate the zero position, "00", as illustrated in FIG. 2, the oven of the cooking apparatus 29 will be maintained at a warmth-retaining and non-cooking temperature in a manner well known in the art until the operator grasps the knob 30 and moves the discs 27 and 28 so that the indicator "manual" of the disc 27 will be viewable in the window 26 of the cooking hours timer means 25 whereby the oven of the cooking apparatus 29 can be subsequently operated in a conventional manner not under the influence of the cooking timer means 25 unless the timer means 25 is again manually set to a new cooking time period.

Therefore, it can be seen that the range timer means 10 of this invention also provides a digital cooking hours timer means 25 completely separate from the conventional clock means 14 so that the housewife or the like will not have to bother with the conventional clock means 14 to set the desired cooking time period for the digital cooking hours timer means 25 and the digital cooking hours timer means 25 will directly indicate the selected cooking time by a digital readout arrangement thereof that is completely separate from the conventional clock means 14. Such digital reading means of the cooking hours timer means 25 will thereafter continuously indicate a digital countdown of the elapsing time period so that the housewife or the like will know how much of the selected cooking time period remains during the running thereof. Also, the digital cooking hours timer means 25 has means hereinafter described that will operate the cooking apparatus 29 during the elapsing of the cooking time period to maintain the oven at the selected temperature and at a set fixed period, such as fifteen minutes, before the termination of the cooking hours of the cooking time period, the digital cooking hours timer means 25 will automatically cut back the temperature in the oven of the cooking apparatus 29 to a warmth-retaining and non-cooking temperature so that when the set cooking time period has completely elapsed, the food can remain in the oven of the cooking apparatus 29 and will not be further cooked therein but will be maintained at a warmth-retaining and non-cooking temperature. Thus, the food can be removed from the oven at any desired time after the cooking time period has elapsed and the food will remain palatable and not be further cooked. At this time the housewife or the like turns off the oven of the cooking apparatus 29 by rotating the knob 30 so that the "manual" indicator of the digital cooking hours timer means 25 will appear at the window 26 whereby the oven of the cooking apparatus 29 can be utilized in a conventional manner or can again be subsequently utilized for automatic cooking operation in the above manner.

While the digital minute timer means 19 in combination with a conventional clock 14 or by itself is the subject matter of a concurrently filed patent application of applicants, Ser. No. 390,024, filed Aug. 20, 1973, now U.S. Pat. No. 3,857,234, the digital timer means, 19 of this application has a few changes in the structure thereof from that disclosed in the aforementioned patent application. However, the digital cooking hours timer 25 of this invention is not disclosed in the aforementioned copending patent application and forms the features of the claimed invention either by itself, in combination with the conventional clock means 14, or in combination with the conventional clock means 14 and the digital minute timer means 19.

Therefore, the details of the parts and the details of the operation of the range timer construction 10 that has been previously generally described will now be described in detail in connection with the remaining Figures of the drawings.

DIGITAL MINUTE TIMER MEANS 19

Figure 5:
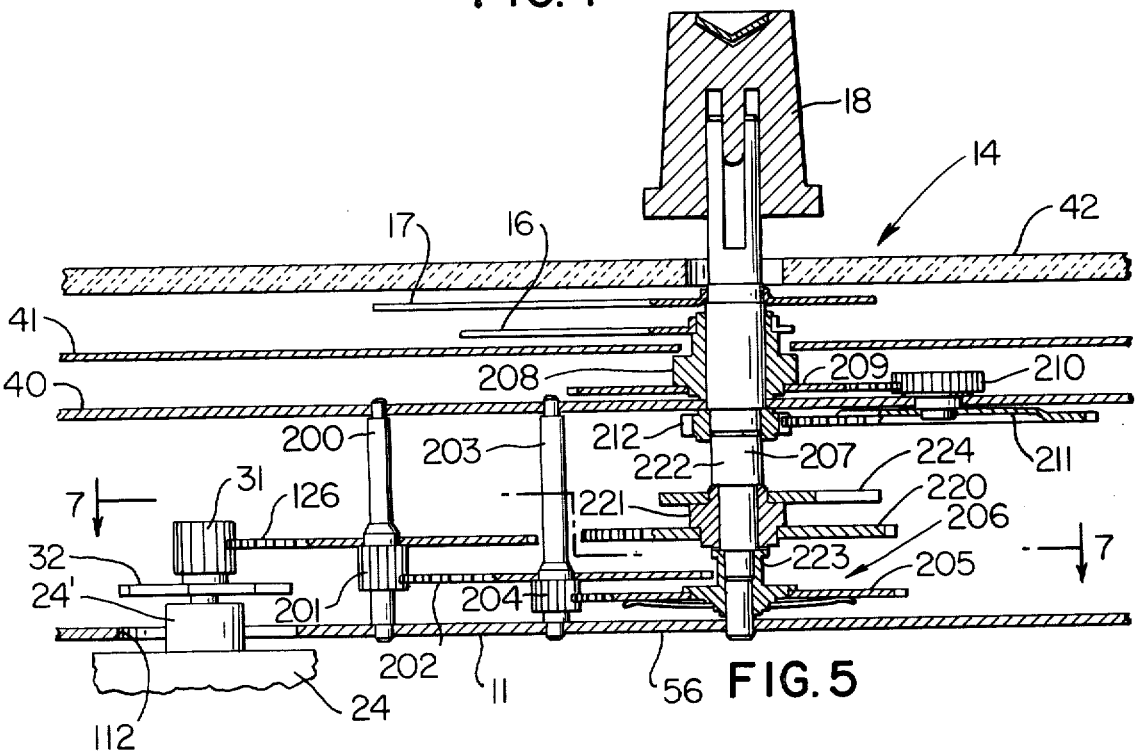
FIG. 5 is an enlarged, fragmentary, cross-sectional view taken substantially in the direction of the arrows 5—5 of FIG. 1 and illustrating the time of day clock structure.

As illustrated in FIG. 5, a synchronous motor and gear unit 24 is carried by the frame means 11 and has an outlet shaft 24' driven at a speed of six revolutions per minute. The output shaft 24' is used for driving the clock mechanism for the conventional clock 14 and the timer means for the digital timers 19 and 25 as will be apparent hereinafter.

Figure 4:
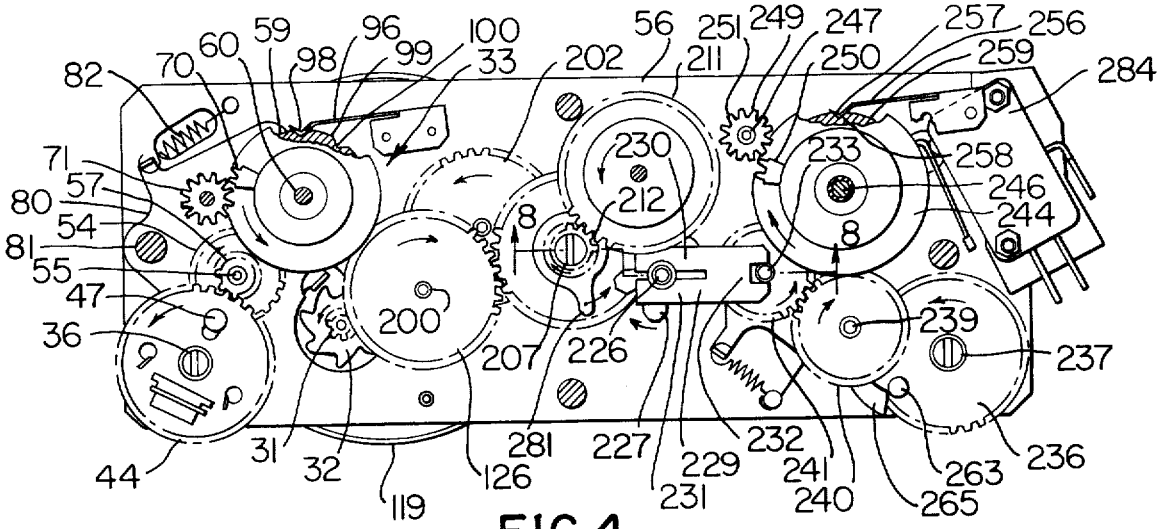
FIG. 4 is a reduced view of the range timer illustrated in FIG. 2 with the timer discs and front frame panel illustrated in FIG. 2 removed.
Figure 6:
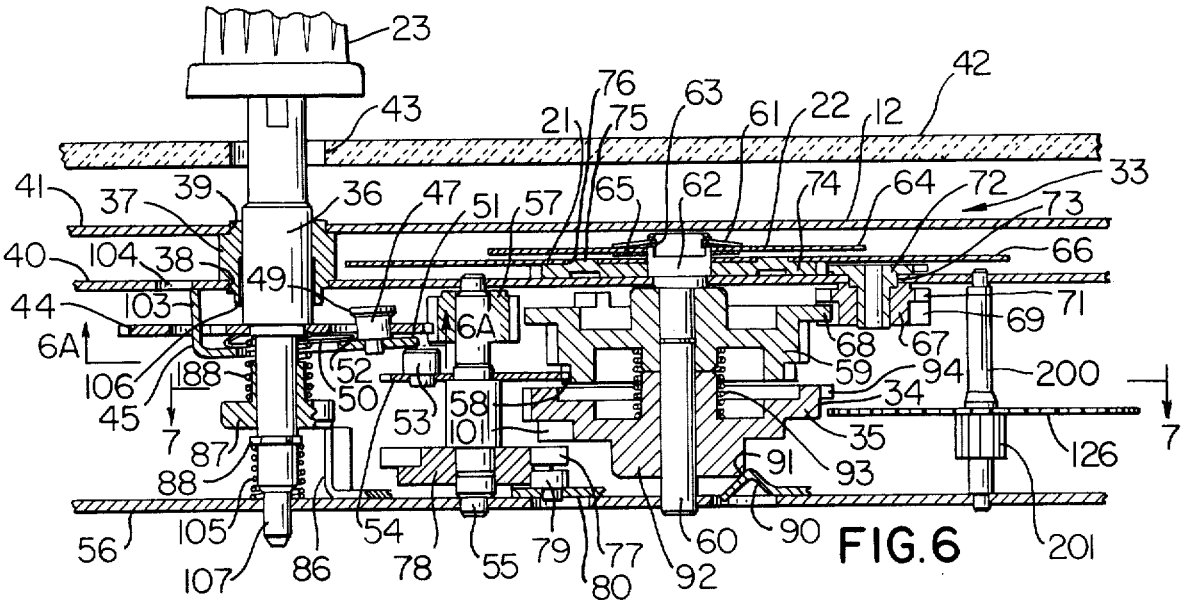
FIG. 6 is an enlarged, fragmentary, cross-sectional view taken substantially in the direction of the arrows 6—6 of FIG. 1 and illustrating the digital minute timer structure.
Figure 7:
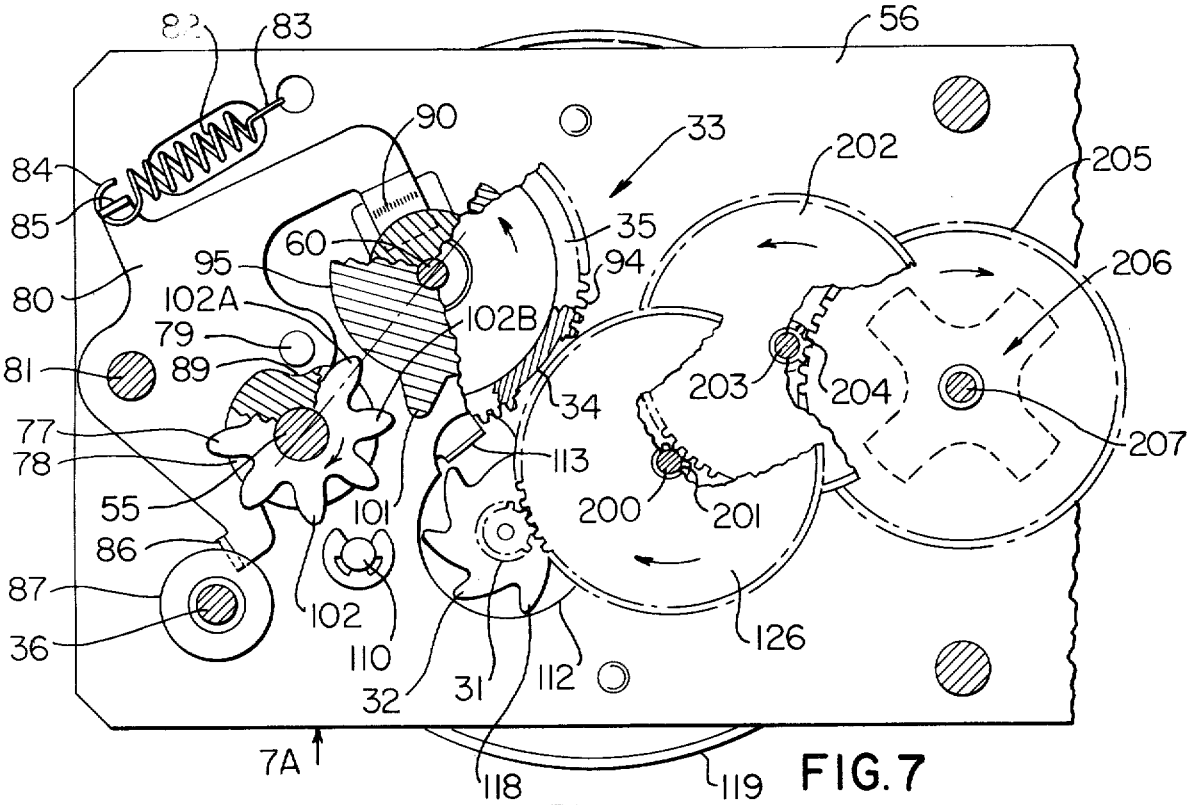
FIG. 7 is a fragmentary, cross-sectional view taken in the direction of the arrows 7—7 of FIG. 6.

A pinion gear 31 and ratchet wheel 32 are respectively attached as drive fits to the continuously rotating one rpm output shaft 24' of the motor 24 as illustrated in FIGS. 5 and 7. As illustrated in FIGS. 4 and 7, the timer mechanism for the digital minute timer means 19 is generally indicated by the reference numeral 33 and is illustrated in FIGS. 4, 6 and 7 as being in its "off" or zero position. Thus, the pinion gear 31 is continuously rotating a meshing gear 126 within a cutout 34 formed in the outer periphery of a molded gear 35. Therefore, with the drive means 33 disposed in its "off" position, no drive is imparted from the continuously rotating drive means 31 to the timer mechanism 33 of the minute timer means 19.

As illustrated in FIG. 6, the setting knob 23 for the digital timer means 19 is attached to a setting shaft 36 which is rotatably mounted to the frame means 11 by a bearing means 37 staked in suitable openings 38 and 39 formed respectively in frame plate 40 and dial plate 41, the frame plate 41 providing on the front side thereof the front dial 12 of the range timer means construction 10 which is adapted to have a transparent plate 42 disposed in front of the same as illustrated in FIG. 6, whereby the setting shaft 36 projects out of an opening 43 formed in the window material 42 in a conventional manner.

Figure 6B:
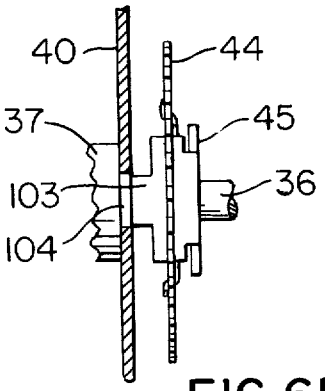
FIG. 6B is a left end view of the structure illustrated in FIG. 6A.
Figure 6A:
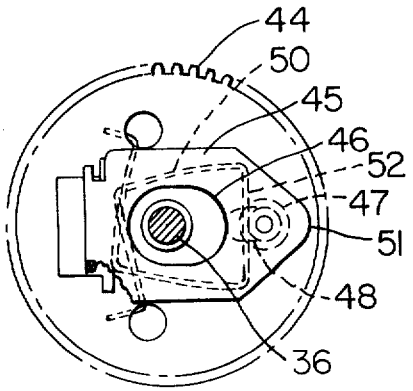
FIG. 6A is a fragmentary, cross-sectional view taken substantially in the direction of the arrows 6A—6A of FIG. 6.
Figure 6C:
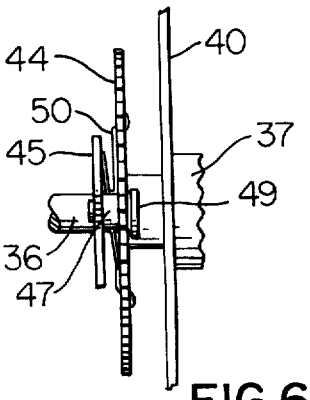
FIG. 6C is a right end view of the structure illustrated in FIG. 6A.

The setting shaft 36 has a gear wheel 44 staked thereto and cooperates with a slider member 45 having an oblong opening 46, FIG. 6A, formed therethrough and receiving the setting shaft 36 therethrough. The slider member 45 has a pin 47 fastened thereto and projecting through an elongated slot 48 formed in the gear wheel 44 and being held captive thereto by an enlarged rivet-like head 49 on the pin 47. A formed wire spring 50 provides a bias to the slider pin 47 and thus to the slider member 45 in two different planes. In particular, the spring 50 provides a bias in a direction whereby a radiused tip or end 51 of the slider member 45 is moved or pressed to its furthermost position from the longitudinal axis of the setting shaft 36, or to the right as illustrated in FIGS. 6 and 6A, because of a rectangular loop 52 thereof bearing against the left-hand side of the pin 47 as illustrated in FIG. 6. The spring 50 also provides a bias in a plane whereby the head 49 of the slider pin 47 tends to engage against the gear wheel 44. However, the slider member 45 is illustrated in FIG. 6 as being in a raised position by being disposed on top of an operating pin 53 that is attached to a gear wheel 54 fixed to a shaft 55 rotatably mounted between the frame plate 40 and a back frame plate 56 of the frame means 11.

As the setting shaft 36 is rotated by the knob 23, the gear wheel 44 attached thereto is also caused to rotate in unison therewith and is disposed in meshing relation with a gear wheel 57 that is fixed to the shaft 55. Thus, the gear wheels 57 and 54 rotate upon rotation of the setting shaft 36 causing the operating pin 53 to rotate out from under the radiused end or tip 51 of the slider member 45 whereby the rotation of the two shafts 36 and 55 will cause the slider member 45 to disengage from the operating pin 53 upon a rotation of the setting shaft 36 in either a clockwise or counterclockwise direction. Such setting mechanism 36 is arranged so that for a setting of one minute on the timer means 19 by rotation of the shaft 36 in either direction, the slider member 45 will disengage from the operating pin 53 and will move to a position wherein the head 49 of the slider pin 47 engages against the gear wheel 44. This will cause the radiused end or tip 51 of the slider member 45 to move to a position within the same plane of the movement of the operating pin 53 of the gear 54.

The gear ratios of the two gears 44 and 57 are so arranged that one full turn of the setting shaft 36 is equivalent to the setting of 30 minutes of the digital minute timer 19 and this causes the shaft 55 to rotate three and three-quarters of a turn, or at a rate of one revolution for each eight minutes of setting of the shaft 36.

These respective rates of revolutions are utilized for the purpose of obtaining multiple revolutions of the setting shaft 36 between successive points of engagement of the slider member 45 with the operating pin 53. With the structure assembled for inline engagement of the slider member 45 with the operating pin 53 at "0" minutes of the timer means 19 as illustrated in FIG. 6, the digital timer 19 may be set by the knob 23 for a period up to 120 minutes before this inline arrangement of the pin 53 and slider member 45 will reoccur. Thus, a setting of two hours for the timer means 19 is therefore equivalent to returning the mechanism to a "0" setting and for this reason the maximum setting time for the particular embodiment of the digital timer means 19 of this invention is one hour and fifty-nine minutes as will be apparent hereinafter.

The gear 54 that carries the operating pin 53 is disposed in meshing relation with gear teeth 58 of a molded gear 59 that is fixed to a shaft 60 rotatably mounted between the frame plates 40 and 56 as illustrated, the shaft 60 loosely receiving and thereby rotatably mounting the previously described gear 35 to the frame means 11. The timer disc 22 that has a section thereof viewably at the window 20 in the front panel 12 or frame plate 41 is fastened for rotation to the shaft 60 by two flats on the shaft 60 and is retained on the shaft by a spring clip 61. The spring clip 61 is assembled by being set on the end 62 of the shaft 60 and is depressed against its bowed spring tension and given one quarter of a turn in a clockwise direction to retain it in an appropriate groove 63 in the end 62 of the shaft 60. Of course, the disc 22 can be fastened to the shaft 60 to rotate in unison therewith in any desired manner.

Numerals from "0" to "9" are printed on the indicator disc 22 adjacent its outer periphery 64 to respectively represent unit minutes that are to be viewed through the aperture or window 20 in the dial or front plate 12.

A thin spacing washer 65 is positioned on the end 62 of the shaft 60 for the purpose of preventing the discs 22 and 21 from scraping each other or having excessive frictional contact therebetween.

The indicator disc 21 is printed with the numerals from "0" to "5" and from "1.0" to "1.5" to indicate the tens of minutes readings about the outer periphery 66 thereof so as to be respectively readable in the window 20 as illustrated in FIG. 1.

The molded gear 59 is disposed in engagement with a special die cast gear 67, FIG. 6, the gear 67 originally being a twelve toothed gear in a plane adjacent to the frame plate or pan 40 and has eight of those teeth removed on one side of the gear 67 to become a four toothed gear in a plane similar to that for the rim 68 of the gear 59, such remaining teeth of the gear 67 being indicated by the reference numeral 69 in FIG. 6. Two teeth 70, FIG. 4, project above the surface of the rim 68 of the gear 59 so as to lie within the same plane as the twelve teeth 71 of the gear 67 to provide a means of providing a locked-in increment drive between the gears 59 and 67.

A pinion gear 72 is assembled as a free running fit through an opening 73 in the plate 40 and is staked to the gear 67 to rotate in unison therewith. The gear 72 is disposed in mesh with a gear wheel 74 disposed in a free running fit on the shaft 60 and retained in position by the plate 40 and the spacing washer 65. Two extruded dowels 75 on the gear 74 are received in complementary openings 76 formed through the disc 21 whereby the indicating disc 21 is fastened for rotation with the gear 74 and may be further fixed thereto by adhesive or other suitable means.

Thus, it can be seen that for each revolution of the shaft 60, the unit minute indicator 22 will move through successive readings from "0" to "9" and by synchronizing the printing and respective gear meshes, the tens of minutes indicating disc 21 will be caused to change its reading one increment in an appropriate manner when the reading changes from "9" back to "0" on the indicating disc 22. In fact, in practice, the numbers of both discs 21 and 22 move together during a change in reading of the tens of minutes.

Accordingly, the setting knob 23 for the timer means 19 can be turned in one direction for increasing readings of minute settings as "0, 1, 2, 3, etc." or in the opposite direction for decreasing readings as "1.59, 1.58, 1,57, etc." of the discs 21 and 22 at the window 20 of the timer means 19 when it is desired to set the timer means 19 for a desired time period.

The shaft 55 has an integral eight toothed gear 77 and cam wheel 78 fixed thereto whereby the integral gear 77 and cam wheel 78 will be rotated during the setting of the timer means 19.

As illustrated in FIGS. 6 and 7, an arming pin 79 is carried by a stop lever 80 so that when the cam wheel 78 is caused to rotate from its zero position upon a setting of the setting shaft 36, the cam plate 78 will raise the arming pin in FIG. 7 and therefore cause the stop lever 80 to pivot on a post or pillar 81 that is carried by the back plate 56 and comprises one of the posts that supports the frame plates 56 and 40 in spaced relation so as to move to a set position against the force of a tension spring 82 having one end 83 secured to the back plate 56 and the other end 84 fastened to an ear 85 of the lever 80.

The lever 80 has a bent ear 86 normally disposed against a plunger 87 loosely disposed on the setting shaft 36 and normally urged toward a retaining ring 88 carried by the setting shaft 36 by a compression spring 188 as illustrated in FIG. 6. Thus, when the lever 80 is cammed in a counterclockwise direction in FIG. 7 by rotation of the cam wheel 78, the tang or ear 86 moves out from engagement with the plunger 87 whereby the plunger 87 will move against the retaining ring 88 by the force of the compression spring 188 and thereby prevent the stop lever 80 from returning to its original position as the ear 86 will engage against the side of the plunger 87 even though the notch 89 in the cam 78 is again in alignment with the arming pin 79 of the lever 80 as illustrated in FIG. 7.

The lever 80 has a V-shaped part or rib 90 normally disposed in engagement with a chamfer 91 on a hub 92 of the gear 35 so that when the lever 80 is cammed in a counterclockwise direction in FIG. 7 by the cam 78 acting on the arming pin 79, the rib 90 is moved away from the chamfer 91 of the gear 35 so that the gear 35 is now free to move against the back plate 56 under the influence of a compression spring 93 acting between the gears 35 and 59.

As the gear 35 is moved toward the back plate 56 by the compression spring 93, the gear teeth 94 of the rear 35 that have not been removed by the cutout 34 are lowered on to the top of the motor driven gear 126. It is not important whether or not the synchronization of mesh of the teeth 94 of the gear 35 with the teeth of the gear 126 is achieved instantaneously because the gears 35 and 126 are of equal size and both rotate at the rate of one revolution per minute and are driven by the motor pinion 126 which is rotating at a rate of six revolutions per minute. Therefore, no more than in interval of time of less than one second can be lost as a result of any lapse in the time before the respective gears 35 and 126 achieve an effective meshing action to permit the gear 35 to move against the backup plate 56 and be directly driven by the drive gear 126.

As the gear 35 is moved toward the back plate 56 by the compression spring 93, a single tooth driving dog 95 that is integral with the gear 35 is lowered into the same plane as the eight toothed gear 77 fixed to the shaft 55. Due to its initial starting position and its direction of rotation, which is counterclockwise in FIG. 7, the driving dog 95 will not impart any restriction to the free rotation of gear 77 for a period of time equal to approximately 50 seconds from the commencement of the setting of the shaft 36 for a setting of a time period for the timer means 19.

While in the previous description of the setting of the timing means 33 for the digital time means 19, all of the components have been free to move without any mechanical resistance other than the arming of the stop lever 80 against the force imposed by its associated spring 82 and by the very small friction of the gear meshes, it may be desired to provide a means of accurate positioning for the numbers on the discs 21 and 22 during a setting thereof whereby an incremental positioning means has been incorporated for the digital timer means 19 as illustrated in FIG. 4.

In particular, a formed leaf spring 96 has an elbow 98 thereof exerting a very light pressure against an outer peripheral surface 99 of the gear member 59 so as to be received respectively in notches 100 at each numeral setting at the window 20 of the range timer 10. Although the detents or notches 100 do not join one another in a continuous uninterrupted sequence, but possess null positions between adjacent settings, it is found in practice that the "feel" of the setting mechanism is such that the natural tendency is to move from one notch 100 to the next whereby it requires a very deliberate intent and action of the operator to produce a half-way setting between the notches 100 and, thus, a half-way setting between numbers at the window 20. Such a half-way setting, however, does not provide for any increment of a minute in the running time of the unit 19 as will be apparent hereinafter and such half-way setting will not cause any damage to the unit 19 as will be apparent hereinafter.

As previously stated, it is considered that the 50 seconds of running time for commencement of the setting of the timer means 19 by the shaft 36 before the driving dog 95 moves its single tooth 101 into a position for its first engagement with a gear tooth 102A of the gear 77 is more than adequate time for achieving an initial setting of the timer unit 19 by the operator. However, when the driving dog 95 does have its tooth 101 rotated into contact with a tooth 102 of the gear 77, the amount of drive during which the driving dog 95 is actually driving gear 77 is approximately five seconds whereas the time in which the driving dog 95 is actually within the track of gear 77 is a slightly longer period of time. It can be seen in FIG. 7 that one tooth 102A of the gear 77 is in a slightly offset position from a line drawn between the center of the two shafts 55 and 60. This position for the gear 77 is determined by the run-out of the driving dog tooth 101 from its previous engagement with the tooth 102B and by the positioning detents 100 of the gear 59. With the gear 77 in the position as illustrated in FIG. 7, it can be seen that the tooth 101 of the driving dog 95 will clear a tooth 102 of gear 77 which is disposed in a position approximately symmetrical to that of tooth 102B and will subsequently engage with tooth 102A to drive the gear 77. In the event of a change of setting being made during the running time of the unit, this may be accomplished during any period of approximately 50 seconds during which time the driving dog 95 is not moving its tooth 101 within the track of the teeth 102 of gear 77. If, however, this engagement should commence during the time of resetting the unit 19, it will be necessary to wait for the completion of the engagement between the dog 95 and the gear 77 before completion of the resetting operation. However, it is to be understood that any means can be provided within the mechanism 33 for overriding the mechanical drive between the dog 95 and gear 77, if desired.

Thus, it can be seen that the shaft 55 is caused to rotate one-eighth turn for each rotation of the dog 95 which occurs once every minute of the running time. Thus, the change of numerals on the discs 21 and 22 will take place as follows.

Approximately 52 seconds after the commencement of setting of the timer means 19 to a desired time period by the setting knob 23, the numerals of the indicating discs 21 and 22 finally set at the window 20 of the selected time period will change by one increment over a period of time of approximately 5 seconds. This change in numerals will reoccur thereafter at intervals of 60 seconds until the completion of the set running time for the timer mechanism 33.

Thus, during the set running time for the timer mechanism 33, the timer mechanism 33 will remain stationary for approximately 55 seconds of each minute and then move one increment, equal to one minute of indicated time, over a period of approximately 5 seconds of drive. This feature, combined with the permutation of revolutions of the slider member 45 and the operating pin 53 provides the following advantages.

During the setting of the timer unit 19, the setting knob is rotated at a rate equivalent to thirty minutes of setting for each complete rotation of the setting knob 23, a rate that is believed to be convenient rate for obtaining a particular timer setting. Also, with the combination of two way setting of the knob 23 and permutated revolutions, a setting of up to one hour and fifty-nine minutes may be achieved without an undue number of revolutions of the setting knob 23 and in the fifty second time before the driving dog 95 initially begins to incrementally drive the gear 77 and, thus, the discs 21 and 22 back to their zero position. However, during the running time for the timer unit 19, the setting shaft 36 advances in increments of 1/30 of a turn over periods of approximately 5 seconds back to its original rotational position. Thus, the setting shaft 36 moves at a rate of one revolution per two minutes and 30 seconds during its actual period of movement to provide a comparatively fast speed for its drop-off position at the end of the timed run as will be apparent hereinafter whereby this combination of features provides a very accurate means of timing for a comparatively long running time mechanism.

The operation of the digital timer means 19 for an initial setting of a selected time period will now be described.

When the operator grasps the knob 23 and rotates the same in either a clockwise or counterclockwise direction to cause the indicating discs 21 and 22 to move in the window 20 to represent the desired time period that the timer 19 is to run for a timing operation, rotation of the shaft 36 causes the gear 44 to rotate the shaft 55 through the meshing of the gear 44 with the gear 57. Rotation of the gear 44 and the gear 54 of the shaft 55 thereby moves the pin 53 from beneath the slider member 45 so that the slider member 45 moves downwardly in FIG. 6 to have its end 51 disposed in the same plane as the pin 53. The rotation of the shaft 55 also causes the cam member 78 to cam the lever 80 in a counterclockwise direction in FIG. 7 to move the tang 86 away from the plunger 87 so that the plunger 87 is moved against the retaining ring 88 by the force of the compression spring 188 to prevent the lever 80 from returning to the position illustrated in FIG. 7. Such movement of the lever 80 moves the rib 90 away from the hub 92 of the gear 35 so that the gear 35 now moves by the spring 93 into meshing relation with the gear 126 so as to be rotated thereby. However, it takes one complete revolution of the gear 35 before the single tooth 101 of the driving dog 95 meshes with a tooth 102 of the gear 77 so that no drive is imparted to the shaft 55 by the drive motor 24 for approximately 50 seconds from the time the gear 34 is initially driven by the drive pinion 31 for the reasons previously described. The setting rotation of the shaft 55 by the setting shaft 36 causes the gear 54 to rotate the gear 59 as the teeth 58 of the gear 59 are disposed in mesh with the teeth of the gear 54. Such rotation of the gear 59 causes the unit minute indicator disc 22 to rotate and serially position the numbers thereon in the window 20 while the disc 21 is caused to rotate one increment each time the gear 59 is rotated one complete revolution as the pair of teeth 70 of the gear 59 only makes contact with one of the teeth 71 on the pinion gear 67 after each revolution of the gear 59. Thus, one revolution of the gear 58 causes the gear 67 to move and through its interconnected pinion gear 72 that is disposed in mesh with the teeth on the gear 74 that is interconnected to the timing disc 21, the tens of minutes indicating disc 21 will change its indication every time the disc 22 moves one complete revolution. Thus, the desired time period appears in the window 20, such as the one hour and forty-eight minute setting illustrated in FIG. 1, and the timer mechanism 33 will run down in a digital countdown manner for the set time period in the following manner.

As the driving dog 94 is now being rotated by the gear 35 being rotated by the driving gear 126, its tooth 101 will at every revolution of the driving dog 95 make contact with a tooth 102 of the gear 77 and cause the same to rotate ⅛ of a turn and thereby cause the shaft 55 to rotate one-eighth of a turn. Such incremental rotation of the shaft 55 causes its gear 54 to rotate and, thus, the gears 59 and 67 to rotate and function in the manner previously described to provide a run down of the time indicated in the window 20 so that the discs 21 and 22 will be incrementally run back toward the zero position therefor which will occur in approximately one hour and forty-eight minutes from the initial setting thereof by the knob 23.

When the timer mechanism 33 has been driven to a position in which the operating pin 53 on the gear 54 is brought into a position of engagement with the end 51 of the slider amount 45 during the run down of a selected time period for the timer means 19, the slider mean 45 is deflected in a leftward radial movement in FIG. 6 on the shaft 36 with respect to the gear 44. However, gear 44, also being simultaneously driven by the gear 57 during the rotation of the shaft 55, causes a tongue 103 on the slider member 45 to move across the face of the frame plate 40 until the tongue 103 enters a slot 104 formed through the frame member 40. With the slider 45 in this new position, the setting shaft 36 is free to move in an axial direction upwardly in FIG. 6 under the influence of a compression spring 105 disposed between the back plate 56 and the retaining ring 88. Thus, the shaft 36 moves upwardly in FIG. 6 will be gear 44 carried thereby comes into engagement with the end 106 of the bushing 37. This action moves the tip 51 of the slider 45 beyond the top of the operating pin 53 and through the slider member 45 cannot return to its fully extended position relative to the gear 44 by the spring 50, due to the engagement of the tongue 103 against the innermost edge of the slot 104, the tip 51 of the slider member 45 will nevertheless move partially across the top of the operating pin 53.

The plunger 87 which has previously been restraining the stop lever 80 from returning to its original "unset" position as illustrated in FIG. 7, is now lifted out of engagement with the tang 86 of the lever 80 so that the spring 82 causes the lever 80 to move in a clockwise direction in FIG. 7 wherein the tab 86 moves to a position in alignment with the plunger 87 as illustrated in FIG. 6 and the stop lever pin 79 moves into the notch 89 of the cam wheel 78. The rib 90 of the stop lever 80 also moves into engagement with the chamber 91 of the gear wheel 35 and cams the same on the shaft 60 away from the end plate 56.

At the instant in which the drive has been transmitted from the driving dog 95 to the gear 77 sufficient to cause the setting shaft 36 to move upwardly in FIG. 6 in the manner previously described, the driving dog 95 has completed its function but still remains within the track of the teeth 102 of the gear 77. If the tooth 101 of the driving dog 95 should remain in this position, it would provide a locking condition when the unit 19 was reset to a new timing condition thereof. However, this problem is overcome because as the gear 35 is raised by the action of the stop lever 80 returning to its normal position, the driving dog 95 is also lifted away from the back plate 56 a distance which is sufficient to move the tooth 101 of the driving dog 95 out of the plane of the teeth 102 of the gear 77. Although the gear 35 has been moved away from the end plate 56, its gear teeth 94 are still within the same plane as the teeth of the motor driven output gear 126 as the cutout 34 thereof has not reached the gear 126. Therefore, the gear 35 will continue to rotate under the influence of the driving pinion 126 causing the driving dog 95 to move its gear tooth 101 to a position which is outside of the track of the teeth 102 of the gear 77 as illustrated in FIG. 7. In this position of the driving dog 95, the motor output gear 126 ceases to drive the gear 35 as the cutout 34 of the driving gear 35 has now reached the gear 126.

This additional running time of the gear 35 after the final drop off is equal to approximately 3 seconds and therefore this amount of time is deducted from the running time of the unit for any setting thereof.

One problem which would appear to be inherent for any mechanical incremental mechanism to be used for a digital minute timer, compared to continuous running timers, is that in the event of cancellation of a setting, a continuously rotating member which provides the time base for controlling the mechanism and which in this instance is the assembly comprising the gear 35 and driving dog 95, may be in an infinitely variable position. If this member should remain in this indeterminate position, it would not provide a correct running time for the unit on its next setting. This problem is increased due to the basic requirements for the times at which the numbers are moved during each minute. For any setting of the indicator discs 21 and 22, this setting will remain visible for the greater portion of one minute and then be driven to its next lowest reading during the last few seconds of that minute. Therefore, a reading of "01" will not commence to change to "00" until the mechanism is within approximately five seconds of its final drop-off position. Thus, when a setting has been cancelled, the mechanism will probably be in a position whereby it is necessary for the driving dog 95 to traverse the position in which it would normally operate one further change of numeral before reaching its datum "off" position. If no suitable provision has been made to counteract this tendency, the mechanism would continue to drive to a reading of "1.59" and therefore run for this further time.

This problem does not normally occur in the design of continuously running timers and is believed to be unique in respect to prior art in the areas of clocks and timers. However, the timer mechanism of this invention has been designed to overcome this problem. In particular, the operation of the digital timer means 19 after cancellation of a time setting thereof has occurred is as follows.

When a setting has been made on the digital timer means 19 and then is cancelled by the operator turning the shaft 36 to position a zero setting in the window 20, the gear 35 will have been moved toward the back plate 56 and then driven to some position other than its normal "start" position. However, when the unit is reset to read "00", the stop lever 80 will immediately raise the gear 35 away from the back plate 56 and gear 35 will continue to be driven by the motor output pinion 126 and therefore will not impart any drive to the rest of the mechanism as the driving dog 95 is raised out of the plane of the gear 77. Thus, the gear 35 will be driven to its normal "start" position as shown in FIG. 7 and will come to rest in this position due to the cutout 34 in the gear face 94 of the gear 35 receiving the drive pinion 126.

Therefore, it can be seen that when the shaft 36 is rotated by the knob 23 to the "0" setting in the window 20, the indicator discs 21 and 22 will not be further driven even though the gear 35 may be further driven by the drive motor 24 in the manner previously described.

The further operation of the timer means 19 at the instant of completion of a normal timed run of the timer means 19 will not be described.

Figure 7A:
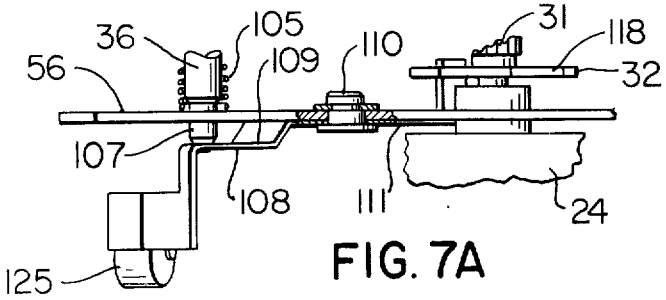
FIG. 7A is a fragmentary end view of the bell-ringing structure of the timer means illustrated in FIG. 7 and taken in the direction of the arrow 7A of FIG. 7.

The end part 107 of the setting shaft 36 which projects beyond the end plate 56 as illustrated in FIGS. 6 and 7A, is in engagement with an edge of a portion 108 of a hammer lever 109 pivotally mounted to the back plate 56 by a pivot pin 110 and normally spring urged in a clockwise direction in FIG. 7 about the pivot pin 110 but being prevented by the end 107 of the shaft 36. A leg 111 of the lever 109 passes through an opening 112 in the back plate 56 and has a tab 113 movable into engagement with the ratchet wheel 32. Thus, as the setting shaft 36 moves upwardly in FIG. 6 upon the completion of a timed cycle in the manner previously described by the force of the compression spring 105 as the tang 103 of the slider member enters the slot 104, the end 107 of the shaft 36 disengages from the portion 108 of the lever whereby the hammer lever 109 is pivoted on the pin 110 by a spring (not shown) having one end interconnected to the back plate 56 while the other end is fastened to the lever 109. When the portion 108 of the lever 109 is released from its engagement with the setting shaft 36, the hammer lever 109 is free to move under the influence of the spring whereby tab 113 on the lever 109 now moves into engagement with the teeth 118 of the ratchet wheel 32. Due to the respective features of the form of the teeth 118 of the ratchet wheel 32 and the pivoting position of the hammer lever 109, the hammer lever 109 is induced to lift slowly and fall rapidly and this action of the hammer weight 125 is induced to strike the bell 119 in a series of blows to produce a continuous chiming action and thus signal the end of the time period of the timer means 19.

The ringing of the bell 119 continues until shut off by utilizing the setting knob 23 in a manner now to be described.

A decorative button 120 is carried by the setting knob 23 so as to provide obvious press button appearance in addition to appropriate instructions which are printed on the dial face 12 as illustrated in FIG. 1 concerning the alarm shutoff. Such button 120 also provides illusion of a shutoff mechanism operated independently of the setting knob 23.

Therefore, when the operator pushes in on the button 120, the entire setting shaft assembly 36 is moved toward the back plate 56 with the exception of the plunger 87 which remains seated on the top of the tab 85 of the lever 80 and the radiused tip 51 of the sliding member 45 which remains on top of the operating pin 53. As the tongue 103 of the sliding member 45 is removed from the slot 104 in the plate 40, the slider member 45 is now free to move to its outer most radial position from the setting shaft 36 under the force of the spring 59 whereby the tongue 103 now moves radially to a position away from its innermost edge of the slot 104. Then as the press button 120 is released, the tongue 103 of the sliding member 45 will now prevent the setting assembly 36 from returning to its outer position as the tongue 103 of the slider member 45 now abuts against the plate 40 as illustrated in FIG. 6.

As the setting shaft 36 and its assembly is depressed by the pushing inwardly on the button 120, the chamfered end 107 of the shaft 36 will engage the portion 108 of the hammer lever 109 and deflect the hammer lever 109 away from its contact with the ratchet wheel 32 whereby the timer unit 19 is now reset to its original position.

Thus, it can be seen that the digital timer means 19 operates in a manner to run down from the set period of time thereof to the "00" position wherein the bell 119 will then be continuously operated until the operator pushes in on the push button 120 of the set knob 23 to terminate the alarm and reset the setting shaft 36 thereof.

If any attempt is made to change a setting of the digital timer 19 during the normal running thereof or any attempt is made at misuse of the unit 19 by setting the indicated numbers in unusual positions in the dial window 20 so that the unit 19 is set to read halfway between numbers, the unit 19 will not measure odd increments of minutes. For example, for a setting of five and one-half minutes whereby the numbers 5 and 6 on the disc 22 are both visible in the dial aperture 20, the teeth 102 of the gear 77 will be displaced from their position as shown in FIG. 7 by half a pitch. As the tooth 101 of the driving dog 95 enters this configuration, it will commence to drive a tooth 102 of the gear 77 at a position which is prior to its normal point of engagement. At this position it would not constitute a jamming situation but would commence driving the mechanism for a time equivalent to 1½ pitches of the teeth 102 on the gear 77. This action would cause the numbers in the dial aperture 20 to move from their previous positions to now indicate a reading of "4" whereas the total length of the timed run would be 5 minutes.

Due to the shape of the teeth 102 on the gear 77 and the tooth 101 on the driving dog 95, the tendency for any jamming of these teeth to occur by producing a butting condition from mis-settings is very remote. However, there is one critical position where this can be achieved but even under these circumstances, the unit 19 is not damaged. Due to the comparatively fast speed of the motor output shaft 24', there is very little gearing between the shaft 24' and the rotor of the synchronous motor 24. A jamming action at these speeds will stall the motor 24 without damaging the unit 19. However, an alternative to this condition is that the motor output pinion 31 can be clutched to the motor output shaft 24' but this has been found unnecessary in the existing unit.

Concerning the possibility of damaging the unit 19 by any attempt to force a setting thereof while a change of numbers is being selected by the mechanism 33, this can be prevented in either of two ways. Probably the most practical method is by employing reasonably strong components and stakings consistent with normal instrument practice and by the use of the setting knob 23 which is not unduly large for the very light setting frictions. An alternative method would be to clutch the setting knob 23 to the setting shaft 36 so that the application of any undue force would be passed by such clutch.

TIME OF DAY CLOCK 14

As illustrated in FIG. 5 and as previously stated, the motor 24 rotates the output pinion 31 at the rate of six revolutions per minute and is disposed in meshing relation with the output gear 126 which drives the digital minute timer means 19 previously described, the gear 126 being fixed to a shaft 200 rotatably mounted between the frame plates 40 and 56 as ilustrated in FIG. 5. The shaft 200 has a pinion gear 201 carried thereon and disposed in meshing relation with another gear 202 fixed to another shaft 203 rotatably mounted between the frame plates 40 and 56 as illustrated, the shaft 203 having a gear 204 fixed thereon and disposed in meshing relation with a gear 205 that forms part of a slip-clutch, generally indicated by the reference numeral 206, carried on a shaft 207 that has the clock setting knob 18 on the outer end thereof and rotatably carries the hour and minute hands 16 and 17 with the minute hand 17 being fixed to the shaft 207 to rotate in unison therewith.

An hour pipe 208 is disposed in a free running fit on the shaft 207 and is retained captive between the plates 41 and 40, the hour pipe 208 being driven by a gear 209 fixed thereto and disposed in meshing relation with another gear 210 rotatably mounted to the frame plate 40 and carrying a gear 211 disposed in meshing relation with a gear 212 carried by the shaft 207 as illustrated whereby rotation of the shaft 207 by the drive motor 24 directly drives the minute hand 17 and indirectly drives the hour hand 16 through the gear train 212, 211, 210, 209 and collar 208.

Also, it can be seen that the clock hands 17 and 16 can be set to a desired time of day by rotation of knob 18 as the slip clutch 206 permits such relative movement of the shaft 207 relative to the drive gears 31, 126, 201, 202, 204 and 205 disposed between the motor 24 and the clutch 206.

Since the clock structure 14 operates in a conventional manner to provide a continuous time of day reading at the dial face 15 in a manner well known in the art, further details of the conventional clock 14 and its operation need not be further set forth in order to understand the features of this invention.

DIGITAL COOKING HOURS TIMER MEANS 25

Figure 8:
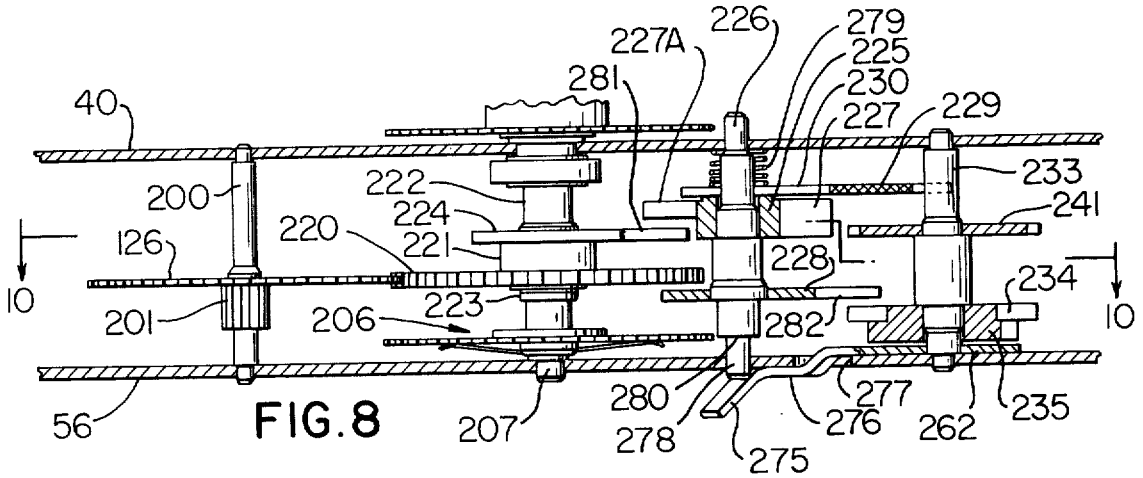
FIG. 8 is an enlarged, fragmentary, cross-sectional view taken substantially in the direction of the arrows 8—8 of FIG. 4.

As illustrated in FIG. 8, the drive gear 126 is also disposed in meshing relation with a gear wheel 220 fixed to a hub 221 loosely disposed on the shaft 207 of the time of day clock 14 and being held captive between an enlarged portion 222, FIG. 5, of the shaft 207 and a hub part 223 of the slip clutch 206 previously described.

A single tooth driving dog 224 is also fixed to the hub 221 and is thereby rotated at a constant speed by the bushing 221 as the gear 126 is continuously rotating under the influence of the drive motor 24.

Figure 10:
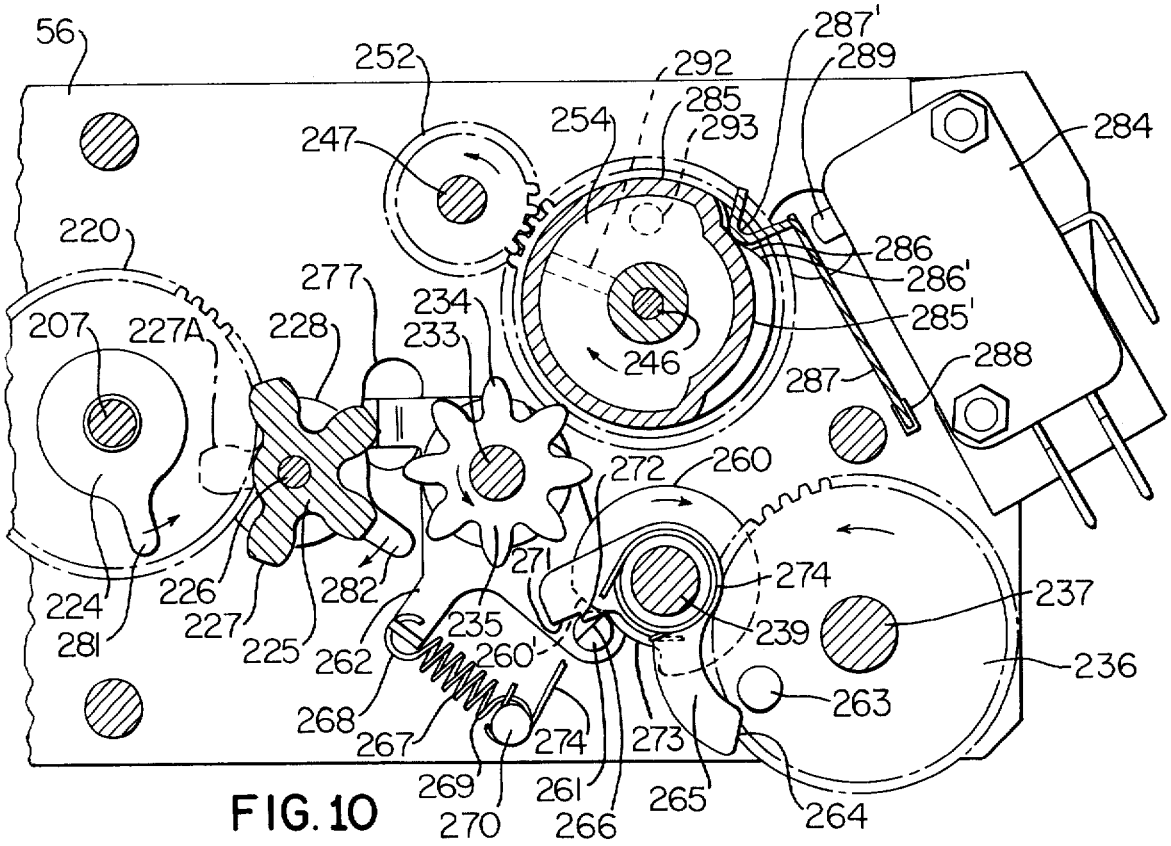
FIG. 10 is a cross-sectional view taken substantially on the line 10—10 of FIGS. 8 and 9.

As illustrated in FIGS. 8 and 10, the driving dog 224 rotates through a radius which intersects with the teeth 227 of a five tooth gear 225 fixed to a shaft 226 rotatably mounted between the frame plates 40 and 56 as illustrated in FIG. 8. One tooth 227A of the five tooth gear 225 is undercut as illustrated in FIGS. 8 and 10 so that when the shaft 226 is disposed in the rotational position illustrated in FIGS. 8 and 10, where the digital cooking timer means 25 is set for "00", no drive will be imparted from the driving dog 224 to the five tooth gear 225 and, thus, the digital cooking timer means 25 will not be operated even though the driving dog 224 is continuously being driven by the output motor 24.

A second single tooth driving dog 228 is fixed to the shaft 226 as illustrated in FIGS. 8 and 10. Also attached to the shaft 226 as a light friction device is a friction plate 229 as best illustrated in FIGS. 8 and 4 which has split legs 230 and 231 respectively gripping against the shaft 226 that passes therebetween and being held from rotation by hahving a bight portion 232 thereof being received about another shaft 233 rotatably mounted between the plates 40 and 56 as illustrated in FIG. 8. Thus, the legs 231 and 230 of the friction plate 229 grip the shaft 226 in such a manner that the shaft 226 will not readily rotate relative to the slip plate 229 unless the gear 225 is being driven by the driving dog 224 in a manner hereinafter set forth. While the friction member 229 can be formed from any suitable material, it has been found that the same can be made from cloth laminated phenolic sheet.

The driving dog 228 has a radius of movement so as to intersect with the teeth 234 of an eight tooth die cast component 235 fixed to the shaft 233. However, the driving dog 228 is normally held in the stationary rotational position illustrated in FIG. 10 outside of a position of effective engagement with the eight tooth gear 235 so that there is no mechanical engagement between the shafts 226 and 233 or between the shaft 226 and the shaft 207. Thus, the shaft assembly 226 is isolated from any mechanical engagement with either of the adjacent shaft assemblies 207 and 233.

For the purpose of achieving a correct performance from each of the mechanical functions which are incorporated into the cooking hours timer mechanism, it is necessary to maintain certain gear meshes and subassemblies in predetermined angular relationships and this requirement commences in the cooking hours timer mechanism with the assembly 226 whereby the friction device 229 previously described has been provided.

Figure 9:
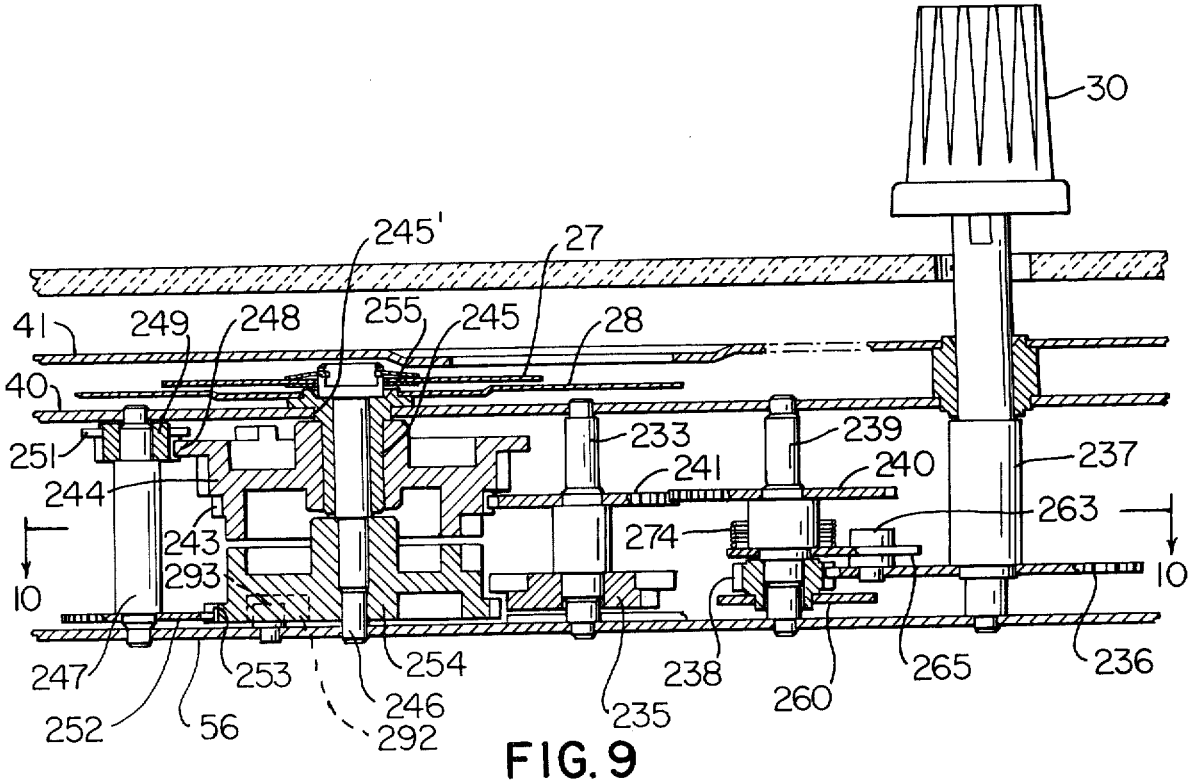
FIG. 9 is an enlarged, fragmentary, cross-sectional view taken substantially on the line 9—9 of FIG. 1 and illustrates the digital cooking hours timer structure.

In FIG. 9, the gear train associated with the setting mechanism for the digital cooking hour timer is illustrated and comprises a gear wheel 236 attached to a setting shaft 237 for the timer means 25, the setting shaft 237 being rotatably mounted to the frame plates 41, 40 and 56 as illustrated and carrying the setting knob 30 on the outer end thereof. The gear 236 is in mesh with a pinion gear 238 attached to a shaft 239 rotatably mounted between the frame plates 40 and 56. A gear 240 carried by the shaft 239 is disposed in meshing relation with a gear 241 carried on the shaft 233 also rotatably mounted to the frame plates 40 and 56. The gear 241 is disposed in meshing relation with a gear face 243 of a molded gear component 244 that is attached to a sleeve 245 loosely rotatably mounted on a shaft 246 rotatably mounted between the frame plates 40 and 56. The sleeve 245 is attached to the indicating wheel 28 as illustrated in FIG. 9 and is rotatably mounted in an opening 245′ in the plate 40, the indicator disc 28 having the five minute increments of cooking time thereon.

A locked-in incremental drive is achieved between the molding 244 and a shaft 247 that is also rotatably mounted to the frame plates 40 and 56. A gear profile on the molding 244 is utilized in conjunction with a stepped gear 249 carried on the shaft 247. In particular, the molding 244 has a pair of gear teeth 250, FIG. 4, which are adapted to receive one of the teeth 251 of the gear 249 therebetween to impose an incremental drive to the gear 249 each time the molding 244 completes one revolution in substantially the same manner as the gear teeth 70 mesh with gear 71 for the digital minute timer 19 previously described. However, due to the differences which exist between the minute timer 19 and the cooking hour timer 25, with respect to the reversed functions of the large and small indicator discs, it is necessary to utilize the shaft 247 instead of the simpler gear assembly 67, 72 previously described.

In particular, the stepped gear 249 that is attached to the shaft 247 transmits the drive thereof to a gear 252 that is interconnected to the shaft 247 and which, in turn, is disposed in meshing relation with a gear face 253 of a molding 254. The molding 254 is fixed to the shaft 246 at the lower end thereof and the hour indicator disc 27 is secured to the upper end of the shaft 246 in the same manner that the disc 22 is secured to the upper end of the shaft 60 of the minute timer 19, a washer 255 being disposed between the discs 27 and 28 for the same reason as the washer 65 previously described.

When it is desired to make a setting, the cooking hour set shaft 237 should be turned clockwise as viewed in FIG. 10 whereby the indicator discs 27 and 28 will be rotated counterclockwise and will cause the numerals to rise in the dial aperture 26 for increasing increments of time. This aspect of vertical movement of the numerals during setting will therefore be comparable to that in the setting of the minute timer means 19. As the setting knob 30 is turned clockwise in FIG. 1, the readings will increase in value from "00" to "05"; "10" etc. up to a maximum setting of "6.55". The rate at which these increments are set is for thirty-two increments (two hours and 40 minutes) per revolution of the setting shaft 237. This is a rate of setting which is comparable to that used in the minute timer mechanism 33 of thirty increments per revolution of the setting shaft 36. Also, by the use of a light detent spring engagement of a leaf spring 256 having its elbow 257 disposed in notches 258 in the outer periphery 259 of the molding 244, similar to the spring means 96 utilized for the molding 59 of the minute timer means 19, the numbers and components of the mechanism for the cooking hour timer means 25 may easily be set in accurate positions thereof.

As the setting wheel 236 is turned by the setting shaft 237, the shaft 239 is turned through the meshing relation of the gear 236 with the gear 238. A lighting profile 260′ on a cam 260 carried by the shaft 239 causes a pin 261, FIG. 10, which is attached to a lever 262 to be set to an armed position thereof, the lever 262 being rotatably mounted on the shaft 233. Lever 262 is armed against the force exerted by an extension spring 267 which is attached to an upstanding tab of lever 262 by a loop 268 at one end of spring 267 and by a similar loop 269 to a post which is mounted in plate 56. Also, a pin 263 which is attached to the setting gear wheel 236 is moved away from a projection 264 of a lever 265 that is freely pivoted on the shaft 239. A machined flat 266 on the pin 261, which has previously been restricting the rotation of the lever 265 under the influence of a torsion spring 274 having one end attached thereto and another end attached to a post 270, now releases the lever 265 to permit the same to move to a new position where a face 271 of the lever 265 now engages the flat 266 of the pin 261. A narrow step 272 of the lever 265 will now lay adjacent to, but not in contact with the outside diameter of the pin 261, due to the slight difference in radius from the center of the shaft 239 to the step 272, compared to the outside diameter of the cam 260.

During the operation of setting the digital cooking hour timer unit 25 up to a maximum time of "6.55", both the setting shaft 237 and the shaft assembly 239 can be turned through several revolutions. In order to prevent the pin 261 from fully entering the cutout 273 of the cam 260 at each revolution of the shaft 239, the mechanism has been designed so that this can only happen for one permutation of revolutions for each of the two shaft assemblies 237 and 239 similar to the principle incurred in the minute timer mechanism 19. The ratio of revolutions between the setting shaft 237 and shaft assembly 239 is at a rate of three turns of the setting shaft 237 for ten turns of the shaft 239.

During the interval of time in which the opening 273 of the cam 260 is adjacent to the pin 261, the pin 261 will be supported on the small step 272 of the lever 265 adjacent to the face 271 thereof. Due to the fact that the pin 261 is a full round diameter at the height of the cam 260, the very slight difference in its position when it is resting on the step of lever 265 will not cause any undue problem when it encounters either end of the cutout 273 in the cam 260. The permutation of the respective revolutions for each shaft assembly 237 and 239 is such that when the pin 263 engages the projection 264 of the lever 265, the cutout 273 in the cam 260 is at some position other than adjacent to the pin 261. Therefore, although the lever 265 may be deflected for three separate settings of the mechanism, the pin 261 cannot drop into the cam opening 273 except for the permutation of component positions for a "00" reading. The small step 272 of the lever 265 has been positioned slightly below the outside diameter of the cam 260 in order that a weak torsion spring 274 wrapped around the pin 270 and hooked to the lever 265 may be sufficient for returning the lever 265 to a position beneath the pin 261 without touching the pin 261 when the pin 261 is seated on the outside diameter of the cam 260.

As the lever 262 is set to the "on" position thereof against the force exerted by the spring 267, a camming face 275 of a part 276 of the lever 262 that passes through an opening 277 in the back frame plate 56, FIG. 8, is retracted from its engagement with the end 278 of the shaft 226 whereby a light compression spring 279 causes the shaft assembly 226 to lower into a position whereby a shoulder 280 on the shaft assembly 226 now moves into contact with the back frame plate 56.

The five tooth gear 227 carried by the shaft 226 which has been previously positioned at a height whereby it is not engaged by the tooth 281 of the driving dog 224 is now lowered into a plane wherein all of the teeth 227 of the gear 225 are now within the track of the driving dog 224. Similarly, the driving dog 228 carried by the shaft 226 has its tooth 282 lowered to within the same plane as the eight teeth 234 of the gear 235. The angular position of the continuously rotating driving dog 224 is not important at the instant at which the shaft assembly 226 is lowered. Variation in the position of this driving dog 224 will affect the amount of time for the first increment of running time, but this cannot be more than one minute, which is the maximum error for any setting of the cooking hours function. If at the instant when the shaft assembly 226 is lowered, the driving dog 224 has its tooth 281 disposed immediately beneath the undercut tooth 227A of the gear 225, the shaft assembly 226 is restrained from any partial movement by the friction plate 229. This insures that the shaft assembly 226 cannot move into a random position whereby the tip of the single tooth 281 of the driving dog 224 may butt with the top of the teeth 227 of the five tooth gear 225 and thereby stall the mechanism. When the driving dog 224 moves into its first engagement with the undercut tooth 227A of gear 225, the shaft assembly 226 is advanced by one fifth turn and moves the driving dog 228 accordingly. It can be seen in FIG. 10 that this moves the driving dog 228 in a clockwise direction for which a total of five such incremental movements are required before any drive is imparted to the setting and indicator gear train assemblies 233, 246, 239 and 237. Thus, the shaft assembly 226 moves one increment each minute of running time of a cooking time period, but only imparts drive to the cooking hours mechanism for one out of each of its five increments because of its simple tooth driving dog 228.

The action provides a movement of the numerals and gear train of approximately three to four seconds duration which occurs once every five minutes. This movement is comparable in speed and duration to the movement of the minute timer assemblies and therefore provides similar benefits for accuracy of drop-off position, etc.

Figure 3:
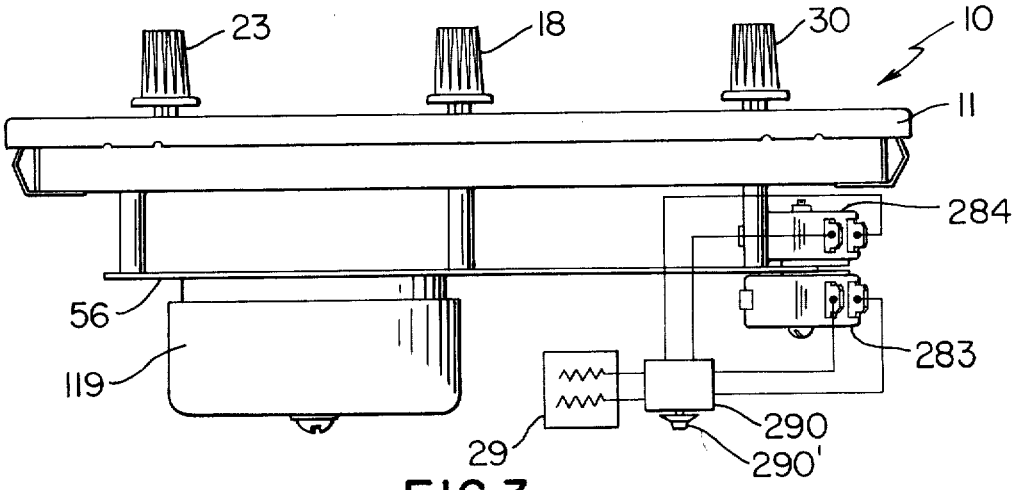
FIG. 3 is a bottom view of the range timer of FIG. 1.

The operation of the two switches 283 and 284, FIG. 3, for the cooking apparatus 29 is by the means of two cams 285 and 286 formed respectively on the gear moldings 244 and 254, each of which acts against a single switch lever 287 that operates both switches 283 and 284. The switch lever 287 has opposed tongues which are located loosely in slots 288 formed in the frame plates 56 and 40. It has been found that the pressure which is exerted by the springs contained within the particular microswitches 283 and 284 on the actuator buttons 289 thereof is more than adequate for moving the switch lever 287 without any necessity for additional springs for the particular lever 287. Thus, it is possible to control the action of the switch contacts within the switches 283 and 284 without any additional spring loading on the cooking hours mechanism.

The cam profile 285 is associated with the indicator disc 28 denoting the five minute increments and have a profile 285′ which enables an "off" or holding "keep warm" position to be maintained by the switches 283 and 284 for readings of "15" to "00" inclusive as the particular cooking time period is elapsing. The other cam profile 286 is associated with the indicator disc 27 denoting the hours of cooking time and possesses a cutout 286′ which enables an "off" or holding "keep warm" position to be maintained for one position only at an equivalent to "0" hours position of the disc 27.

Thus, the disc 27 must be indicating "0" hours for the cutout 286′ to be adjacent the elbow 287′ of the lever 287 and then the disc 28 must be indicating "15" minutes before the lever can move into the position illustrated in FIG. 10 whereby such position of the lever causes the oven of the cooking apparatus to be turned "off" or be placed in a warmth retaining and non-cooking temperature condition of 170° F or the like in a manner well known in the art.

When a cooking hours time setting has been made on the cooking hours mechanism, the lever 262 will be armed and the shaft assembly 226 will be lowered into contact with the back plate 56 as previously described.

Figure 11:
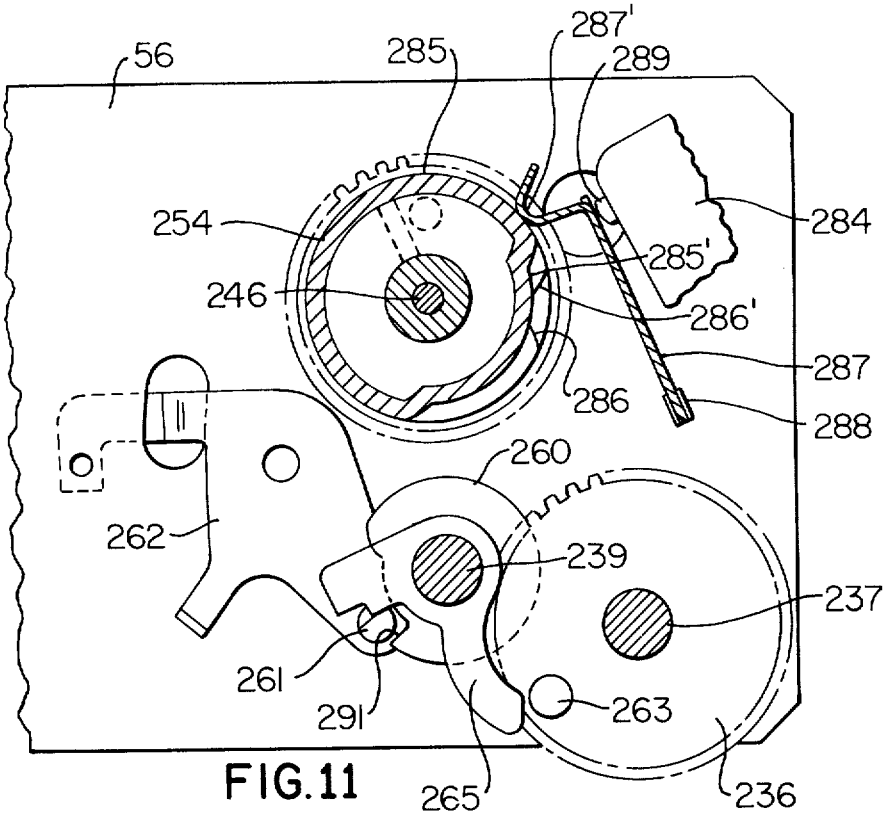
FIG. 11 is a view similar to FIG. 10 with certain parts thereof removed and illustrating the structure of FIG. 10 set in a "manual" position thereof.

The timer mechanism then will operate in an incremental manner similar to the operation previously described for the minute timer means 19 except that each increment will be of five minutes duration with approximately four seconds of each increment in which the mechanism will be moved. During the running time for the unit 25, a position will be reached in which the indicated reading changes from "20" to "15" which will be exactly 15 minutes before the end of a timed run. As the numerals and mechanism are moved to this increment, the switch lever 287 of the switches 283 and 284 will be lowered into the cutout 285′ of the cam 285 and the cutout 286′ of the cam 286 thus changing the contact position in the microswitches 283 and 284. When the mechanism moves through its final incremental movement from "05" to "00", the opening 273 in the cam 260 will move to a position of clearance for the pin 261. The pin 261 will however be retained on the small step 272 of the lever 265 until the pin 263 finally disengages the step 272 from beneath the pin 261 by the gear 236 moving to the position of FIG. 10 and acting on the end 264 of the lever 265 at the last part of the incremental movement for a rapid release of the lever 262. This rapid movement of the lever 262 is employed to raise the shaft assembly 226 to the position as illustrated in FIG. 8 by the end 275 of the lever 262 camming against the shaft 226. The cooking hour mechanism will now be disengaged from any further drive and the components will maintain their respective positions as shown in FIG. 10. This position is however only employed for a temporary holding "keep warm" or "off" condition and the unit 25 must then be reset manually for normal manual operation of the oven thermostat 290, FIG. 3. This is achieved by turning the setting knob 30 of the cooking hour timer 25 counterclockwise for one increment whereby the word "MANUAL" on disc 27 is now positioned in the opening 26 and the components are moved to the positions as shown in FIG. 11. In particular, the lever 262 maintains its engagement with the shaft assembly 226 thus insuring that no drive is transmitted to the cooking hours mechanism during the movement of the shaft 237 to the "MANUAL" position and a stop face 291 of the cam 260 moves into close proximity to the pin 261 providing a "MANUAL" stop position. The switch cams 285 and 286 also move to positions whereby lever 287 again actuates the buttons 289 of the switches 283 and 284 to reset the same to their "on" positions so that the thermostat 290 can operate the oven of the cooking apparatus 29 in a conventional manner without having an automatic cooking operation thereof.

Figure 12:
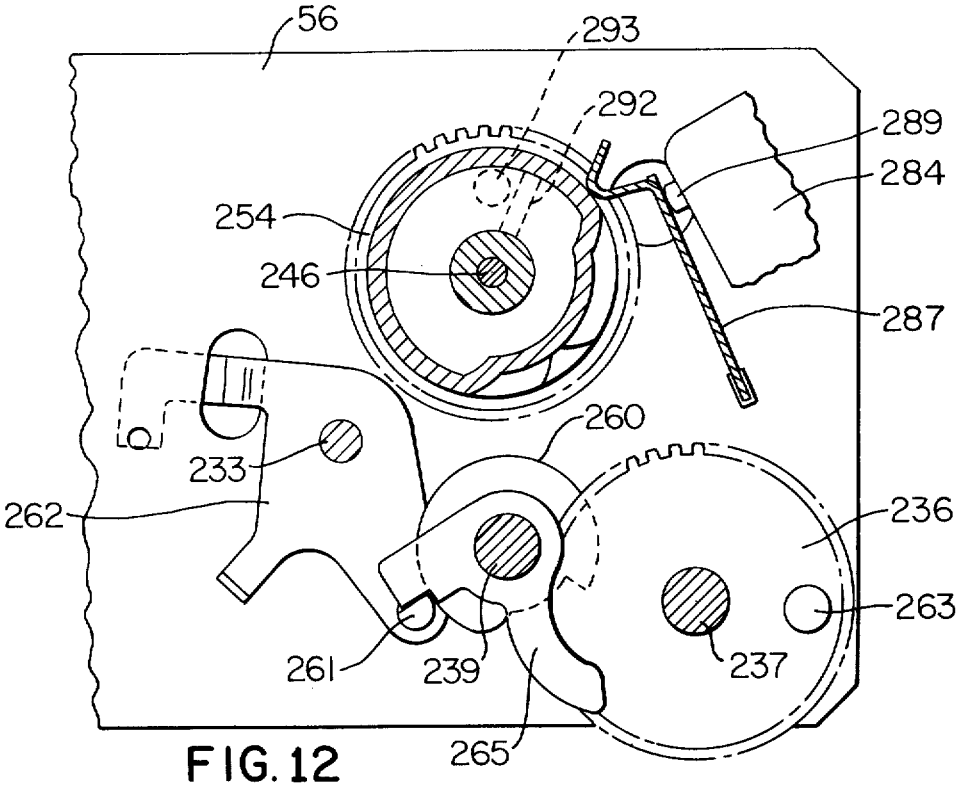
FIG. 12 is a view similar to FIG. 11 and illustrates the digital cooking timer means of FIG. 11, set for a time period of six hours and fifty-five minutes.

In order to prevent the timer means 25 previously described from being set beyond its capability of correct indication and function, a manual over wind stop has been introduced which limits the settings of the cooking hour timer means 25 to "6.55". This stop position is achieved by means of a rib 292 on the part 254 which engages a stop pin 293 carried by the back plate 56 as illustrated in FIG. 12. This rib 292 and stop pin 293 permits movement of the gear part 254 for all of the eight forty-five degrees incremental positions of the hour indicator disc 27 but it prevents any setting to be made beyond the six hour division for this disc 27. The position of the components for this setting of "6.55" is illustrated in FIG. 12.

In the event of canceling a setting of the cooking timer means 25 after the set time period has begun to run, the shaft assembly 226 may be in any one of its five incremental positions. Due to the action of the cam 260, the pin 261 and the lever 262, when the unit is returned to the reading of "00" or "MANUAL", the shaft assembly 226 will be raised to its position of height as shown in FIG. 8. The driving dog 228 will be raised to its position whereby no further drive can be transmitted to the mechanism comprising the setting and indicating gear train assemblies 237 and 246. The shaft assembly 226 may however be in an angular position whereby further drive can be transmitted to this assembly by the driving dog 224. If the angular position of this assembly is such that the driving dog 224 encounters any of the four teeth 227 which are not undercut on the gear 225, the shaft assembly 226 will continue to be rotated in incremental movement until it reaches the position as indicated in FIGS. 8 and 10. This action results in running out any portion of a five minute increment which may remain in the unit 25 after a cancellation of a setting in order to provide correct running time for any following setting which is made.

The operation of the cooking hour timer means 25 in connection with the cooking apparatus 29 will now be described.

After the housewife or the like places the desired food to be cooked in the oven of the cooking apparatus 29, she turns the thermostat 290 to the desired cooking temperature that the heating means of the oven is to maintain in a conventional manner.

Thereafter, she sets the timer means 25 through the knob 30 thereof to the desired cooking time period that the oven is to cook the food placed therein. In particular, she grasps the knob 30 and turns the same in a direction to cause the setting shaft 237 to rotate and through its meshing relation of the gear 236 with the gear 238, the gear 240 with the gear 241 and the gear 241 with the gear 243, the minute indicator disc 28 is rotated in the aperture 26 and through the interconnection of the pair of teeth 250 on the gear member 244 with the teeth of the gear 249 of the shaft 247, the hour disc 27 will be appropriately rotated in the aperture 26 so that when the selected cooking time period, such as the 3 hours and 20 minutes of FIG. 1 has been selected by the housewife, the timer means 25 will run down in a visual countdown of five minute increments from the 3 hour and 20 minute setting back to the "0" setting thereof and during such time the oven of the cooking apparatus 29 will cook the item under the control of the thermostat 290 and the switches 283 and 284 as the cams 285 and 286 are holding the switch lever 287 in its "in" position toward the switches 283 and 284.

During the initial rotation of the shaft 237 for the setting of the digital cooking hours timer means 25, the pin 263 on the gear wheel 236 is moved away from the end 264 of the lever 265 whereby the spring 274 tends to pivot the lever 265 in a counterclockwise direction in FIG. 10. As the gear 236 rotates, and, thus, rotates the shaft 239 through its meshing relation with the gear 238 on the shaft 239, the cam 260 rotates and cams against the pin 261 and moves the same outwardly so that the lever 262 pivots in a clockwise direction on the shaft 233 in the manner illustrated in FIG. 10 whereby such pivoting action of the lever 262 permits the shaft 226 of FIG. 8 to move downwardly under the force of the spring 279. However, the driving dog 224, being in a random angular position at the instant of commencing the setting operation, will impart its first driving increment to the tooth 227A at a variable interval not exceeding one minute. Such subsequent rotation of the shaft 226 by the dog 224 now causes the dog 228 to drive the gear 235 and, thus, the shaft 233 which, in turn, drives the setting shaft assembly 237 and indicating shaft assembly 246 back to their "00" positions.

During the entire time that the selected cooking time period of the timer means 25 is elapsing in the above manner, the cams 285 and 286 maintain the lever 287 in its "in" position whereby the thermostat 290 causes the food to be cooked at the set cooking temperature. However, when the elapsing time reaches the "15" minute setting thereof, the cutout profile 286' of the cam 286 has already reached the elbow 287' of the lever 287 in the manner illustrated in FIG. 10 and the cutout 285' in the cam 285 now reaches a position where the lever 287 can be received in the cutout 285' as illustrated in FIG. 10 so that it can be seen that for the next 15 minutes of operation of the timer means 25, the lever 287 operating the switches 283 and 284 has now moved outwardly from the buttons 289 thereof as illustrated in FIG. 10 so that the switches 283 and 284 operate the thermostat 290 in such a manner that the same will permit the temperature in the oven of the cooking apparatus to be reduced down to a non-cooking and warmth retaining condition, such as 170° which temperature will be maintained at the termination of the elapsing cooking time period when the same indicates that the time of "00" has been reached. Alternately, such out position of the lever 287 can cause the thermostat 290 to merely turn off the oven, if desired. Thus, the oven 29 will maintain the cooked food at a warmth retaining and noncooking temperature or the oven will merely be in an "off" condition thereof until the housewife desires to remove such cooked food from the oven. At this time, the housewife rotates the knob 30 of the cooking hours timer means 25 to position the "MANUAL" portion of the disc 27 in the aperture 26 whereby the cams 285 and 286 now act against the lever 287 for the switches 283 and 284 in the manner illustrated in FIG. 11 to move the lever 287 toward the switches 283 and 284 and thereby reset the same so as to permit the thermostat 290 to be used for normal manual operation under the control of its own selector knob 290' and thereby be useable for controlling the oven without a timed cooking period, if desired.

While the digital cooking hours timer means 25 has been previously described as being adapted to be moved from its "00" position to a "MANUAL" position, this "MANUAL" position is not required if the timer means 25 is fabricated to be a self-clearing timer unit. Thus, for a self-clearing timer unit there is no necessity for restricting a range of settings to "6.55" or to introduce any manual setting stops in the timer means 25. The permutation of revolutions for the various components and assemblies for the cooking hours mechanism for the previously described "MANUAL" unit and for a "self-clearing" unit has been designed so that the same can provide a two-way setting for a self-clearing timer unit but be provided with the limit stops 292 and 293 for the "MANUAL" unit for reasons previously stated.

Figure 13:
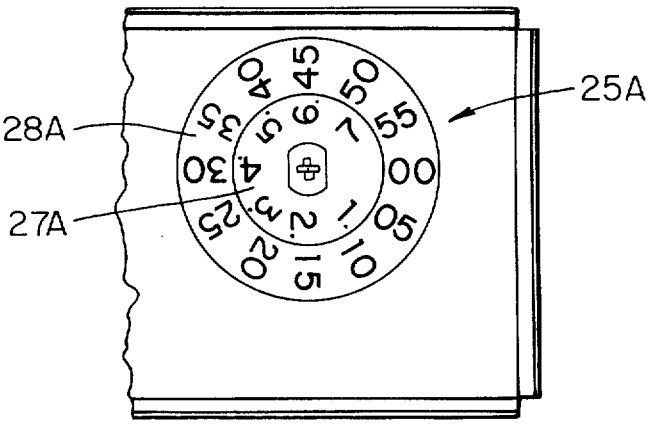
FIG. 13 is a fragmentary view similar to FIG. 2 and illustrating another embodiment of the digital cooking timer means, such timer means providing for a self-clearing thereof.
Figure 14:
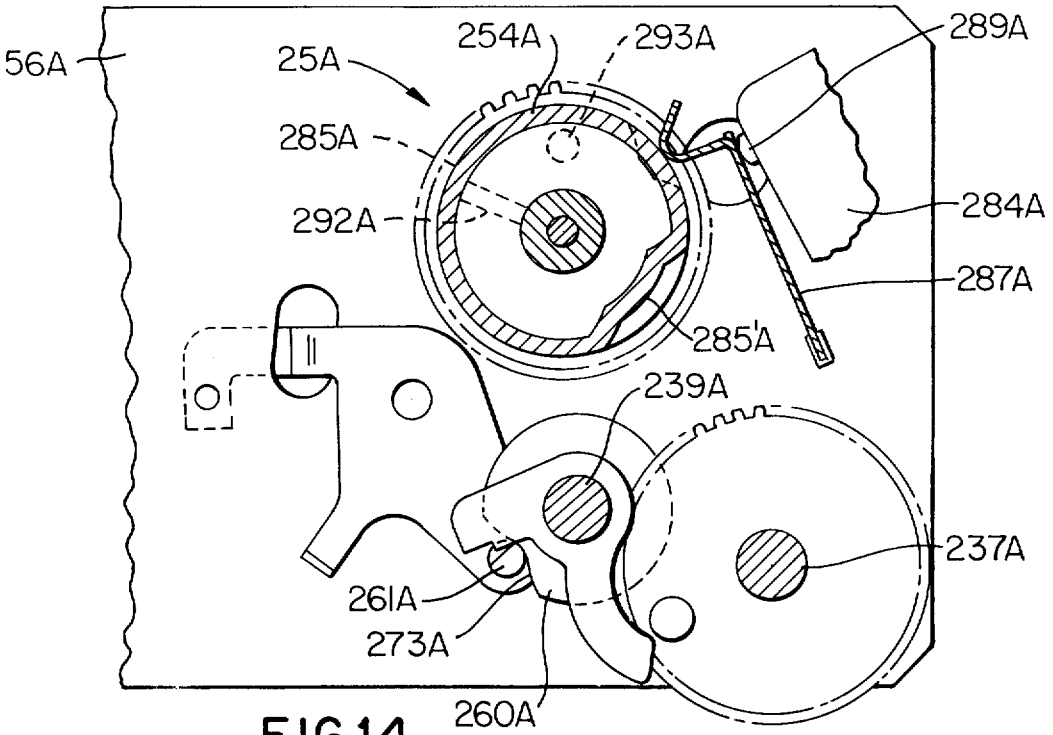
FIG. 14 is a view similar to FIG. 11 and illustrates the self-clearing embodiment of FIG. 13.

Therefore, reference is now made to FIGS. 13 and 14 wherein a self-clearing digital cooking hours timer means is generally indicated by the reference numeral 25A and parts thereof similar to the timer means 25 previously described are indicated by like reference numerals followed by the reference letter "A".

In the self-clearing timer unit 25A, three full turns of the setting shaft 237A will provide ten turns of the shaft assembly 239A and a setting of ninety-six increments. Ninety-six increments are equivalent to eight hours but will cause a full range of settings on the indicator discs 27A and 28A and return the same to a "00" reading as shown in FIG. 13. Therefore, the maximum setting time for the self-clearing unit 25A is "7.55".

As illustrated in FIG. 14, the components of the self-clearing unit 25A are somewhat different from those of the "MANUAL" unit 25. In particular, the cam 260A has its opening 273A suitable for only one incremental position which is for a reading of "00" and has camming slopes for the pin 261A suitable for a two-way setting rotation of the cam 260A. The switch 285A has its cutout 285'A reduced when compared to the cam profile 285' previously described for the purpose of reducing the time in which the switches are in the position for actuating a holding "keep warm" circuit.

The stop pin 293A which was previously employed in the "MANUAL" unit 25 is not required in the unit 25A but the rib 292A can be left on the molding 254A, if desired.

The action of the switch lever 287A, in association with the cam 285A is to release the switch button 289A fifteen minutes before the end of the cooking time and to depress it again at five minutes before the end of the cooking time whereby such action on the switches 283A and 284A causes the same to have the thermostat 290 maintain the same warmth retaining and non-cooking temperature in the oven when the timer means 25A reaches the "00" position so that the housewife or the like need not operate the setting shaft means 237A for the timer means 25A thereafter before the same can be utilized for another timing operation or the cooking apparatus 29A can have the thermostat 290A operate the same in a conventional manner without timing operation thereof.

While the features of this invention are to utilize the digital cooking hours timer means 25 or 25A in combination with the time of day clock means 14 and/or digital timer means 19 or by itself, it is to be understood that the time of day clock means 14 can be utilized with the digital minute timer means 19 without the use of the digital cooking hour timer means 25 or 25A previously described.

Figure 15:
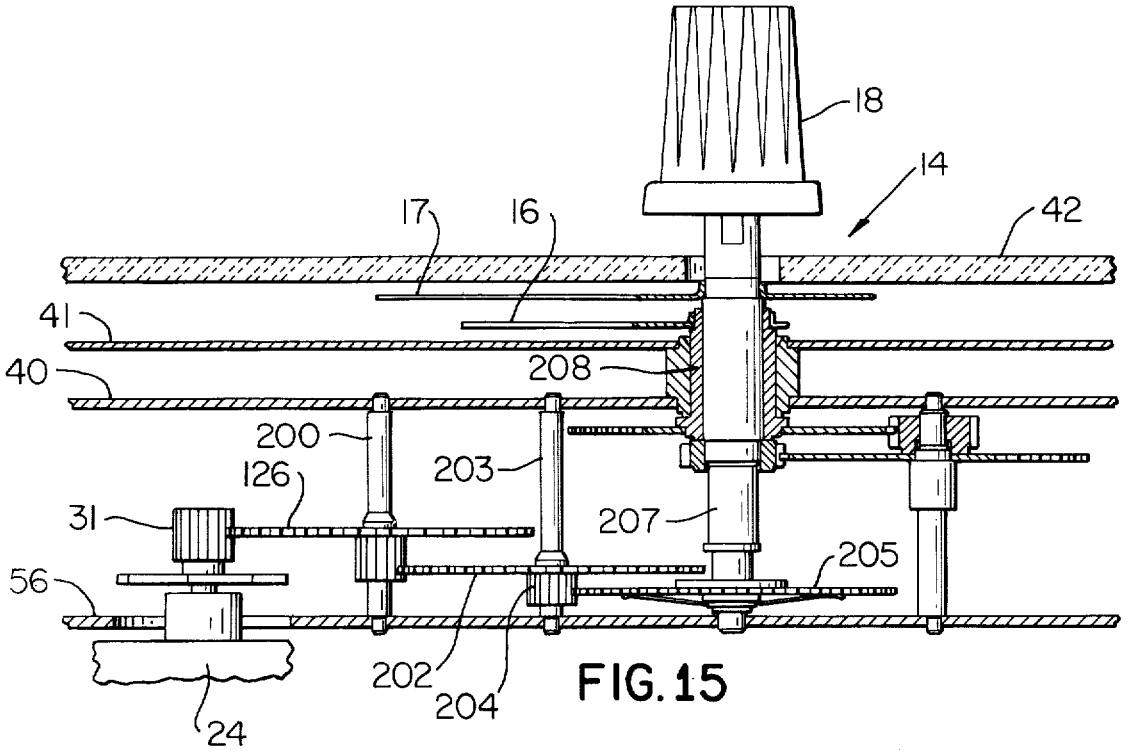
FIG. 15 is a view similar to FIG. 5 and illustrates another embodiment of this invention.

Thus, reference is made to FIG. 15 wherein it can be seen that the time of day means 14 can be modified from the structure illustrated in FIG. 5 through the elimination of the hub 221 and driving dog 224, as well as gear 220, so that the drive motor 24 will merely provide the drive means for the time of day means 14 as well as for the digital timer means 19 previously described.

Therefore, it can be seen that this invention not only provides an improved range timer having a digital cooking hours timer with direct reading for the setting thereof and for a countdown reading thereof from a setting of anywhere from "05" to "6.55" for the "MANUAL" timer means 25 and to "7.55" for the self-clearing timer means 25A, but also this invention provides a digital cooking timer means that can be utilized by itself, if desired.

While the forms of this invention now preferred have been described and illustrated as required by the patent statutes, it is to be understood that other forms can be utilized and still come within the scope of the appended claims.

What is claimed is:

1. In a range timer having a cooking hours timer means for providing an automatic cooking operation of a cooking apparatus for a time period selected by setting setting means of said timer means at a selected period of cooking time of said timer means, the improvement wherein said cooking hours timer means has digital reading means for indicating the set period of time thereof, said reading means comprising two concentrically disposed different sized discs having time indicating indicia on the outer peripheries thereof, the smaller of said discs having said time indicating indicia thereof providing hours and the larger of said discs having said time indicating indicia providing minutes, said range timer having a window for exposing adjacent parts of said outer peripheries of said discs whereby the exposed indicia at said window provides said selected period of cooking time, one of said discs having a part thereof indicating a "manual" setting of said timer means, said part that indicates said "manual" setting being viewable at said window when said timer means is set in said "manual" position thereof.

2. In a range timer as set forth in claim 1, said part indicating said "manual" setting of said timer means completely filling said window when said timer means is set in said "manual" position thereof.

3. In a range timer as set forth in claim 2, said part indicating said "manual" setting of said timer means being carried by the smaller of said discs.

* * * * *